US009165454B2

(12) United States Patent
Inagaki et al.

(10) Patent No.: US 9,165,454 B2
(45) Date of Patent: Oct. 20, 2015

(54) SECURITY SYSTEM, PROGRAM PRODUCT THEREFOR, AND SURVEILLANCE METHOD

(71) Applicant: DENSO CORPORATION, Kariya, Aichi-pref. (JP)

(72) Inventors: Tokuya Inagaki, Nishio (JP); Kenji Mutou, Kariya (JP); Masumi Egawa, Anjo (JP); Hiromasa Hanai, Toyokawa (JP)

(73) Assignee: DENSO CORPORATION, Kariya (JP)

( * ) Notice: Subject to any disclaimer, the term of this patent is extended or adjusted under 35 U.S.C. 154(b) by 169 days.

(21) Appl. No.: 13/963,169

(22) Filed: Aug. 9, 2013

(65) Prior Publication Data

US 2014/0043159 A1 Feb. 13, 2014

(30) Foreign Application Priority Data

Aug. 10, 2012 (JP) ..... 2012-178166

(51) Int. Cl.

| | |
|---|---|
| ***G08B 21/00*** | (2006.01) |
| ***G08B 23/00*** | (2006.01) |
| ***G08B 25/00*** | (2006.01) |
| ***G08B 29/18*** | (2006.01) |

(52) U.S. Cl.

CPC ..... *G08B 23/00* (2013.01); *G08B 25/00* (2013.01); *G08B 29/185* (2013.01)

(58) Field of Classification Search

CPC ..... G08B 23/00; G06K 9/6267; G06K 9/46; G06K 9/626; G06K 2009/4666

USPC ..... 340/540, 541; 382/159, 197

See application file for complete search history.

(56) References Cited

U.S. PATENT DOCUMENTS

| | | | | |
|---|---|---|---|---|
| 6,060,994 | A * | 5/2000 | Chen | 340/521 |
| 7,015,806 | B2 * | 3/2006 | Naidoo et al. | 340/531 |
| 7,450,006 | B1 * | 11/2008 | Doyle et al. | 340/541 |
| 7,671,728 | B2 * | 3/2010 | Buehler | 340/506 |
| 8,624,735 | B2 * | 1/2014 | Kellen et al. | 340/541 |

(Continued)

FOREIGN PATENT DOCUMENTS

| | | | |
|---|---|---|---|
| JP | S62-147890 | A | 7/1987 |
| JP | 2002-271522 | A | 9/2002 |

(Continued)

OTHER PUBLICATIONS

Office Action issued on Jul. 8, 2014 in the corresponding JP Application No. 2012-178166 (with English translation).

*Primary Examiner* — Eric M Blount

(74) *Attorney, Agent, or Firm* — Posz Law Group, PLC

(57) ABSTRACT

In a security system, a first collecting module cyclically collects target-object information indicative of environments of a target object and a monitored area in which the target object exists. An alarm module determines whether there is an abnormal situation associated with at least one of the target object and the monitored area based on the target-object information, and sets off an alarm indicative of a result of the determination that there is an abnormal situation. A second collecting module cyclically collects circumstance information indicative of a situation of an area surrounding the monitored area. An abnormal situation determining module calculates, based on the circumstance information, a probability that an abnormal situation associated with at least one of the target object and the monitored area will occur, and determines whether the probability is equal to or higher than a threshold level.

9 Claims, 9 Drawing Sheets

(56) References Cited

U.S. PATENT DOCUMENTS

| | | | | |
|---|---|---|---|---|
| 8,779,921 | B1 * | 7/2014 | Curtiss | 340/541 |
| 8,885,929 | B2 * | 11/2014 | Ni et al. | 382/159 |
| 2002/0126009 | A1 * | 9/2002 | Oyagi et al. | 340/541 |
| 2009/0303042 | A1 * | 12/2009 | Song et al. | 340/566 |
| 2011/0254680 | A1 * | 10/2011 | Perkinson et al. | 340/506 |
| 2012/0092161 | A1 * | 4/2012 | West | 340/540 |
| 2012/0257061 | A1 * | 10/2012 | Edwards et al. | 348/153 |

FOREIGN PATENT DOCUMENTS

| | | | |
|---|---|---|---|
| JP | A-2007-257113 | * | 1/2007 |
| JP | 2007-257113 A | | 10/2007 |
| JP | 2011-044037 A | | 3/2011 |
| JP | 2011-100224 A | | 5/2011 |

* cited by examiner

SECURITY SYSTEM, PROGRAM PRODUCT THEREFOR, AND SURVEILLANCE METHOD

CROSS REFERENCE TO RELATED APPLICATIONS

This application is based on Japanese Patent Application 2012-178166 filed on Aug. 10, 2012. This application claims the benefit of priority from the Japanese Patent Application, so that the descriptions of which are all incorporated herein by reference.

TECHNICAL FIELD

The present disclosure relates to security systems for monitoring whether there are abnormal situations associated with target objects, program products for configuring computers as the security systems, and methods of monitoring target objects.

BACKGROUND

There are many security systems for monitoring whether abnormal situations associated with target objects have occurred. An example of these security systems is disclosed in Japanese Patent Application Publication No. 2002-271522.

In the security system disclosed in the Publication 2002-271522, a home security terminal monitors whether there has been an abnormal situation associated with a target object, i.e. a target home. In addition, an in-vehicle terminal monitors whether there has been an abnormal situation associated with a target object, i.e. a target vehicle. When the home security terminal determines that there has been an abnormal situation associated with a target object based on the monitored result, the home security terminal sends information about the occurrence of the abnormal situation associated with the target object to a center server. Similarly, when the in-vehicle terminal determines that there has been an abnormal situation associated with a target object based on the monitored result, the in-vehicle terminal sends information about the occurrence of the abnormal situation associated with the target object to the center server.

When receiving the information about the occurrence of the abnormal situation associated with the target object from at least one of the home security terminal and the in-vehicle terminal, the center server sends information indicative of the occurrence of the abnormal situation to a mobile terminal of the owner of the target object corresponding to the at least one of the home security terminal and the in-vehicle terminal.

Note that the Publication No. 2002-271522 discloses thefts, fires, break-ins, or other abnormal events associated with target objects as examples of abnormal situations associated with the target objects.

SUMMARY

As described above, when an abnormal situation associated with a target device has occurred, the security system disclosed in the Publication No. 2002-271522 sends information about the occurrence of the abnormal situation associated with the target object to the mobile terminal of the owner of the target object.

However, the security system disclosed in the Publication No. 2002-271522 only detects that an abnormal situation associated with a target device has occurred, and therefore, the security system cannot detect access of a suspicious person or suspicious object to a target object before the occurrence of an abnormal situation associated with the target object. Thus, the security system cannot take any necessary measures against access of a suspicions person or suspicious object until an abnormal situation associated with a target object occurs.

In view of the aforementioned circumstances, one aspect of the present disclosure seeks to provide a security system capable of addressing the problem set forth above.

Specifically, an alternative aspect of the present disclosure aims to provide such a security system capable of carrying out necessary actions before the occurrence of an abnormal situation associated with a target object.

A further aspect of the present disclosure aims to provide a program product for functioning a computer as such a security system. A still further aspect of the present disclosure aims to provide a method of monitoring a target object, which is capable of carrying out necessary actions before the occurrence of an abnormal situation associated with the target object.

In a first exemplary aspect of the present disclosure, there is provided a security system. In the security system, a first information collecting module cyclically collects, as target-object information, information indicative of environments of a target object and a monitored area in which the target object exists. In the security system, an alarm module determines whether there is an abnormal situation associated with at least one of the target object and the monitored area based on the target-object information collected by the first information collecting module. The alarm module sets off an alarm indicative of a result of the determination that there is an abnormal situation associated with at least one of the target object and the monitored area.

In the security system, a second information collecting module cyclically collects, as circumstance information, information indicative of a situation of an area surrounding the monitored area. An abnormal situation deter mining module calculates, based on the circumstance information collected by the second information collecting module, a probability that an abnormal situation associated with at least one of the target object and the monitored area will occur. The abnormal situation determining module determines whether the probability that an abnormal situation associated with at least one of the target object and the monitored area will occur is equal to or higher than a threshold level.

As described above, the security system according to the first exemplary aspect, in addition to using the first information collecting module for cyclically collecting the target-object information indicative of the environment of the target object and the monitored area, uses the second information collecting module for cyclically collecting the circumstance information indicative of the situation of the surrounding area around the monitored area.

This configuration of the security system calculates, based on the circumstance information collected by the second information collecting module, the probability that an abnormal situation associated with at least one of the target object and the monitored area will occur, and determines whether the calculated probability that an abnormal situation associated with at least one of the target object and the monitored area will occur is equal to or higher than the threshold level.

That is, the configuration of the security system makes it possible to determine whether the calculated probability that an abnormal situation associated with at least one of the target object and the monitored area will occur is equal to or higher than the threshold level before the occurrence of an abnormal situation.

Thus, it is possible to perform one or more measures against the occurrence of an abnormal situation before the occurrence of an abnormal situation upon determination that the calculated probability that an abnormal situation associated with at least one of the target object and the monitored area will occur is equal to or higher than the threshold level. This results in an increase in the reliability of the security system. For example, a controlling module of the security system increases an amount of the target-object information collected by the first information collecting module before the occurrence of an abnormal situation.

In the security system according to the first exemplary aspect, the abnormal situation determining module determine whether there is an abnormal situation associated with at least one of the target object and the monitored area based on the target-object information collected by the first information collecting module, and set off an alarm indicative of a result of the determination that there is an abnormal situation associated with at least one of the target object and the monitored area.

Thus, if it is determined that the probability that an abnormal situation associated with at least one of the target object and the monitored area will occur is equal to or higher than the threshold level, the abnormal situation determining module can determine whether there is an abnormal situation associated with at least one of the target object and the monitored area based on the increased amount of the target-object information. Thus, the abnormal situation determining module more safely determines whether the probability that an abnormal situation associated with at least one of the target object and the monitored area will occur.

Note that an alarm according to the first exemplary aspect can include: sound or light for warning someone existing in the monitored area; sound or light for informing someone existing around the monitored area of the occurrence of an abnormal situation; and information indicative of the occurrence of an abnormal situation to be sent to someone outside the monitored area.

According to a second exemplary aspect of the present disclosure, there is provided a computer program product. The computer program product includes a non-transitory computer-readable medium; and a set of computer program instructions embedded in the computer-readable medium. The instructions cause a computer of a security system to:

receive target-object information cyclically collected by another computer and sent therefrom, the target-object information being indicative of environments of a target object and a monitored area in which the target object exists;

receive circumstance information cyclically collected by another computer and sent therefrom, the circumstance information being indicative of a situation of an area surrounding the monitored area;

calculate, based on the circumstance information collected by the second information collecting module, a probability that an abnormal situation associated with at least one of the target object and the monitored area will occur; and determine whether the probability that an abnormal situation associated with at least one of the target object and the monitored area will occur is equal to or higher than a threshold level.

As in the case of the first exemplary aspect, the program product according to the second exemplary aspect permits a computer of a security system to perform one or more measures against the occurrence of an abnormal situation before the occurrence of an abnormal situation upon determination that the calculated probability that an abnormal situation associated with at least one of the target object and the monitored area will occur is equal to or higher than the threshold level. This results in an increase in the reliability of the security system according to the first exemplary aspect.

According to a third exemplary aspect of the present disclosure, there is provided a method of monitoring a target object in a security system. The method includes cyclically collecting, as target-object information, information indicative of an environment of the target object and a monitored area in which the target object exists, and determining whether there is an abnormal situation associated with at least one of the target object and the monitored area based on the collected target-object information. The method includes setting off an alarm indicative of a result of the determination that there is an abnormal situation associated with at least one of the target object and the monitored area, and cyclically collecting, as circumstance information, information indicative of a situation of an area surrounding the monitored area. The method includes calculating, based on the collected circumstance information, a probability that an abnormal situation associated with at least one of the target object and the monitored area will occur, and determining whether the probability that an abnormal situation associated with at least one of the target object and the monitored area will occur is equal to or higher than a threshold level.

As in the cases of the first and second exemplary cases, the method according to the third exemplary aspect is capable of performing one or more measures against the occurrence of an abnormal situation before the occurrence of an abnormal situation upon determination that the calculated probability that an abnormal situation associated with at least one of the target object and the monitored area will occur is equal to or higher than the threshold level. This also results in an increase in the reliability of the security system according to the third exemplary aspect.

The above and/or other features, and/or advantages of various aspects of the present disclosure will be further appreciated in view of the following description in conjunction with the accompanying drawings. Various aspects of the present disclosure can include or exclude different features, and/or advantages where applicable. In addition, various aspects of the present disclosure can combine one or more feature of other embodiments where applicable. The descriptions of features, and/or advantages of particular embodiments should not be constructed as limiting other embodiments or the claims.

BRIEF DESCRIPTION OF THE DRAWINGS

Other aspects of the present disclosure will become apparent from the following description of embodiments with reference to the accompanying drawings in which.

DETAILED DESCRIPTION OF EMBODIMENT

An embodiment of the present disclosure will be described hereinafter with reference to the accompanying drawings.

Figure 1:
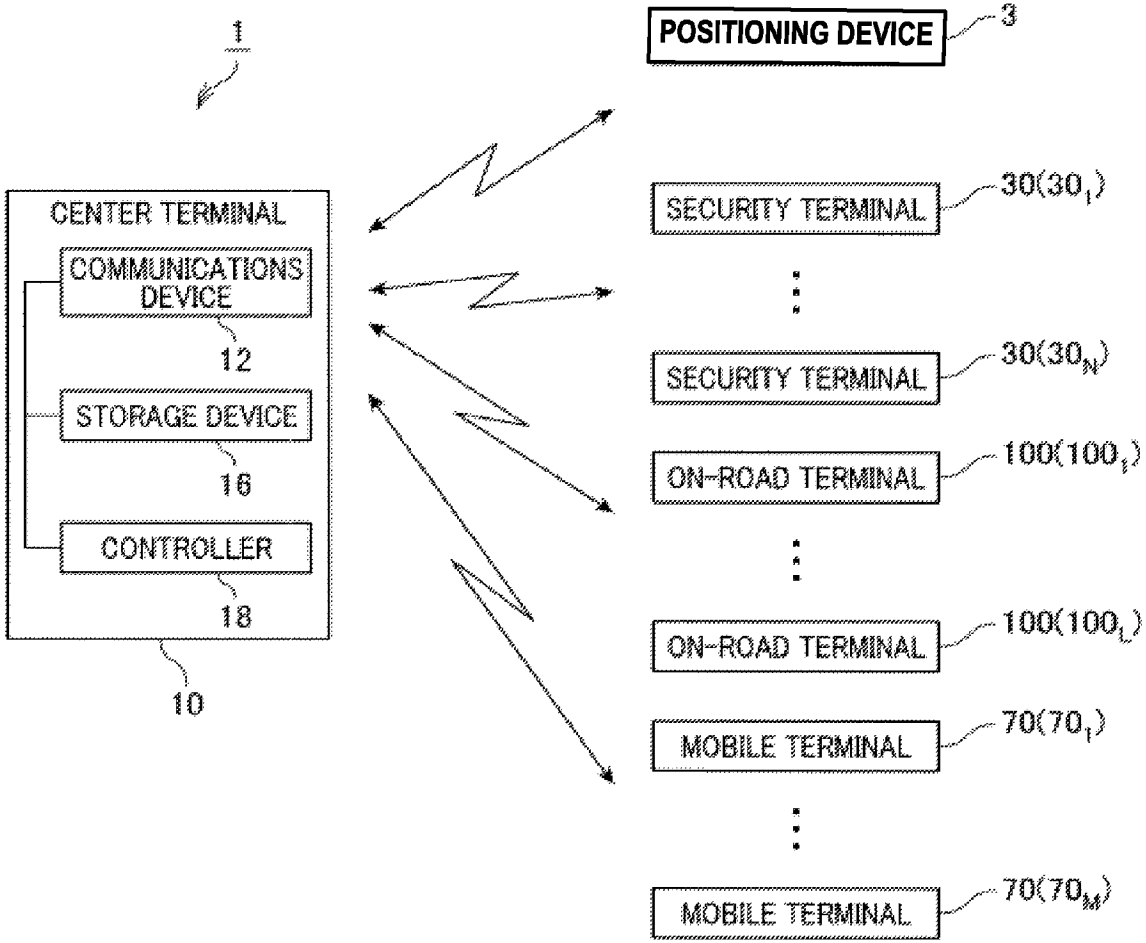
FIG. 1 is a block diagram schematically illustrating an overall structure of a security system according to an embodiment of the present disclosure.

An example of the overall structure of a security system 1 according to this embodiment of the present disclosure is illustrated in FIG. 1.

Referring to FIG. 1, the security system 1 is designed to monitor whether there have been abnormal situations associated with target objects, and set off an alarm if it is determined that there has been an abnormal situation associated with a target object based on the monitored results.

Specifically, the security system 1 includes at least one positioning device 3, a plurality of security terminals 30, a plurality of mobile terminals 70, a plurality of on-road terminals 100, and at least one center terminal 10. In this embodiment, the security terminals 30 can also be individually represented as N security terminals $\mathbf{30}_1$ to $\mathbf{30}_N$, the mobile terminals 70 can also be individually represented as M mobile terminals $\mathbf{70}_1$ to $\mathbf{70}_M$, and the plurality of on-road terminals 100 can also be individually represented as L on-road terminals $\mathbf{100}_1$ to $\mathbf{100}_L$. Note that each of the characters N, M, and L is an integer equal to or more than 1.

To the security terminals 30, the mobile terminals 70, and the on-road terminals 100, unique IDs are respectively assigned.

Each of the security terminals 30 serves to monitor whether an abnormal situation associated with a corresponding target object has occurred, and set off an alarm if it is determined that there has been an abnormal situation associated with the corresponding target object based on the monitored results.

Specifically, the security terminals 30 are installed in respective target homes as respective target objects. Each of the security terminals 30 is operative to collect information about the circumstances in a corresponding monitored area WA containing a corresponding target object. The monitored area WA for a target object according to this embodiment is defined as an area containing the location of the target object and its surroundings, such as the site of the target home. Specifically, the monitored area WA for a target object has a predetermined three-dimensional shape and size previously determined relative to the target object. Information indicative of, for example, the location, shape and size of the monitored area WA for each target object can be determined based on the location of a corresponding target object. The information about the circumstances in the monitored area WA including the corresponding target object will be referred to as target-object information.

Figure 2:
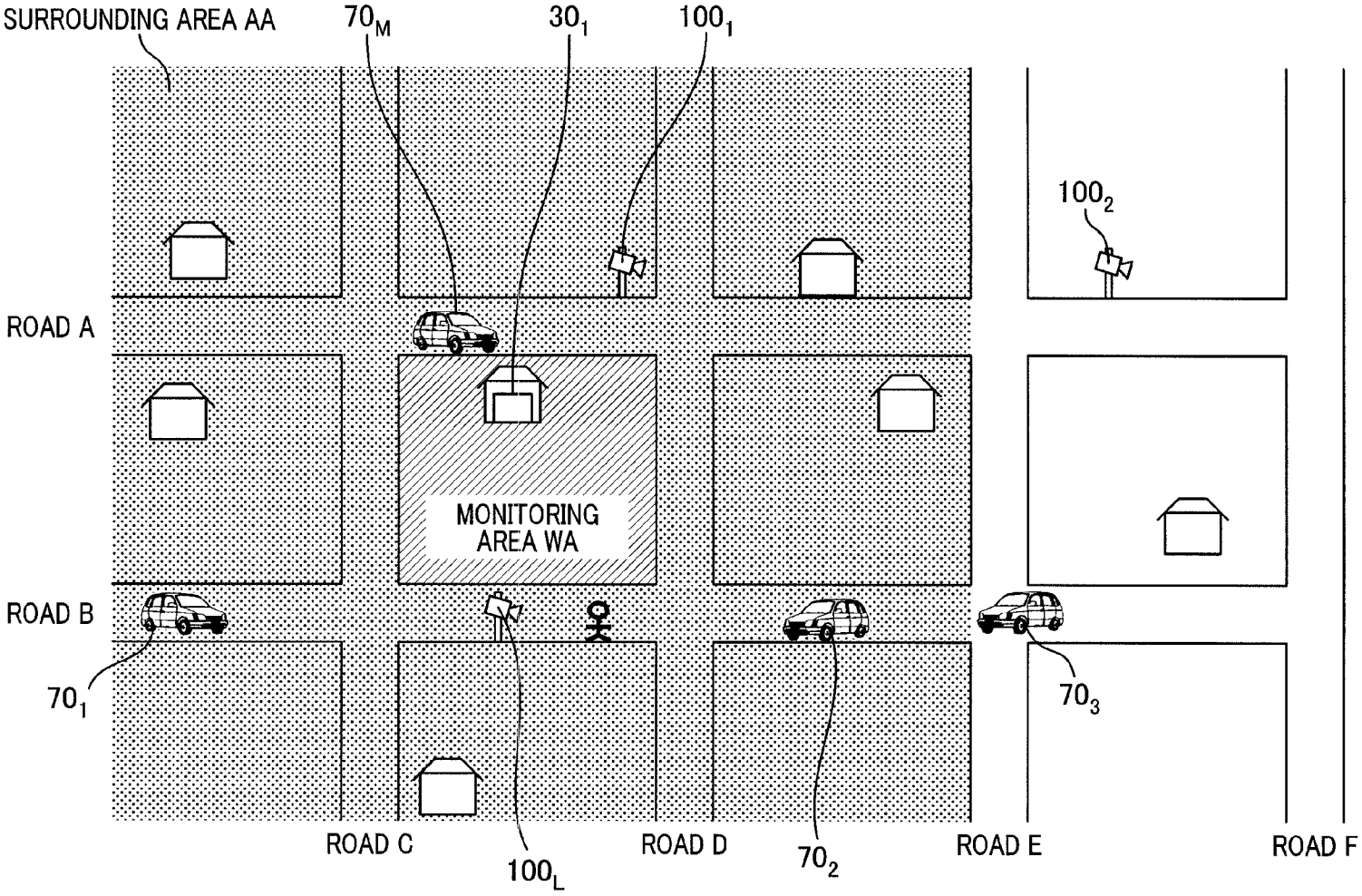
FIG. 2 is a view schematically illustrating an example of a monitored area in which a target object exists and an example of a surrounding area surrounding the monitored area according to the embodiment.

For example, referring to FIG. 2, the security terminal $\mathbf{30}_1$ is installed in a target home $T_1$ specified as a target object. The security terminal $\mathbf{30}_1$ is operative to collect information about the condition in the site of the target home $T_1$ as a monitored area WA thereof. Note that the monitored area WA of the target home $T_1$ is surrounded by roads A, B, C, and D. Assuming that the top side of FIG. 2 is the north, the road A is located in front of the north side of the monitored area WA, and the road B is located in front of the south side thereof. The road C is located in front of the west side of the monitored area WA, and the road D is located in front of the east side thereof.

Note that abnormal situations associated with a target object according to this embodiment include many situations associated with the target object other than normal situations associated therewith. For example, a gas leakage in a target object, a fire in the target object, a break-in at the target object, and a theft from the target object are included in the abnormal situations associated with the target object.

The mobile terminals 70 are installed in respective mobile objects. Each of the mobile terminals 70 is operative to collect information about the circumstances surrounding a corresponding one of the mobile objects. For example, referring to FIG. 2, the mobile terminals $\mathbf{70}_1$, $\mathbf{70}_2$, $\mathbf{70}_3$, and $\mathbf{70}_M$ are for example installed in motor vehicles running around the monitored area WA. Specifically, the motor vehicle in which the mobile terminal $\mathbf{70}_M$ is installed is running on the road A, and the mobile terminal $\mathbf{70}_1$ to $\mathbf{70}_3$ are running the road B.

The on-road terminals 100 are mounted on one or more roads. Each of the on-road terminals 100 is operative to collect information about the circumstances surrounding the location thereof on a corresponding road. For example, referring to FIG. 2, the on-road terminals $\mathbf{100}_1$, and 1002 are for example located on the road A, and the on-road terminal $\mathbf{100}_L$ is for example located on the road B.

In this embodiment, an area AA including the monitored area WA and its surroundings is defined as a surrounding area AA. For example, a substantially cubic or spherical area around the monitored area WA. If the surrounding area AA has a substantially cubic area, it is from a several meters square to a several hundred meters square. If the surrounding area AA has a substantially spherical area, it is from a several meters radius to a several hundred meters radius. If the surrounding area AA is a substantially rectangular solid area around the monitored area WA, it has a major side of several hundred meters at the most. That is, the location, shape, and size of the surrounding area AA defined for each monitored area WA can be defined based on, for example, monitored-area information indicative of the location, shape and size of a corresponding monitored area WA.

As the at least one positioning device 3, a plurality of GPS (Global Positioning System) satellites or a plurality of mobile stations, which are operative to provide location information required to identify the position of each of the security terminals 30, the mobile terminals 70, and the on-road terminals 100.

The center terminal 10 is operative to communicate with the security terminals 30, the mobile terminals 70, and the on-road terminals 100. The communications obtain the target-object information about the monitored area WA for each of the security terminals 30, and monitored-area circumstance information indicative of the environments of the surrounding area AA around each of the monitored areas WA. The center terminal 10 is also operative to identify, based on the obtained target-object information and the obtained monitored-area circumstance information, at least one target object, which should be monitored for determining whether an abnormal situation associated with the at least one target object has occurred, and a corresponding at least one monitored area WA.

Referring to FIG. 1, the center terminal 10 is comprised of a communications device 12, a storage device 16, and a controller 18.

The communications device 12 is operative to perform communications with the security terminals 30, the mobile terminals 70, and the on-road terminals 100. The communications obtain the target-object information about the monitored area WA for each of the security terminals 30, and the monitored-area circumstance information about the surrounding area AA for each of the monitored areas WA.

For example, the controller 18 is designed as a device based on a normal microcomputer comprised of a ROM, a RAM, a CPU, and so on. The controller 18, which for example serves as an abnormal situation determining module and a controlling module, is operative to control the communications device 12 and the storage device 16.

The storage device 16 is designed as a rewritable non-volatile memory. In the storage device 16, the unique IDs assigned to the respective terminals 30, 100, and 70 various programs, which the controller 18 performs, are stored. The various programs include a program, referred to as an area management program, which causes the controller 18 to perform an area management task.

The area management task is designed to identify, based on at least the target-object information obtained by the communications device 12, at least one target object and a corresponding at least one monitored area WA, which should be monitored for deter mining whether an abnormal situation associated with the at least one target object has occurred. The various programs also include a program, referred to as an abnormal-situation probability calculating program, which causes the controller 18 to perform an abnormal-situation probability calculating task.

The abnormal-situation probability calculating task is designed to:

calculate, based on at least the monitored-area circumstance information obtained by the communications device 12, an abnormal-situation probability for a monitored area WA, which represents the probability that an abnormal situation associated with the monitored areas WA will occur; and perform, based on the abnormal-situation probability for the monitored area WA, a precaution for addressing a cause of an abnormal situation associated with the monitored area WA.

A cause of an abnormal situation associated with a monitored area WA is, for example, access of a suspicious person or suspicious object, such as a suspicious motor vehicle, toward the monitored area WA.

Figure 3:
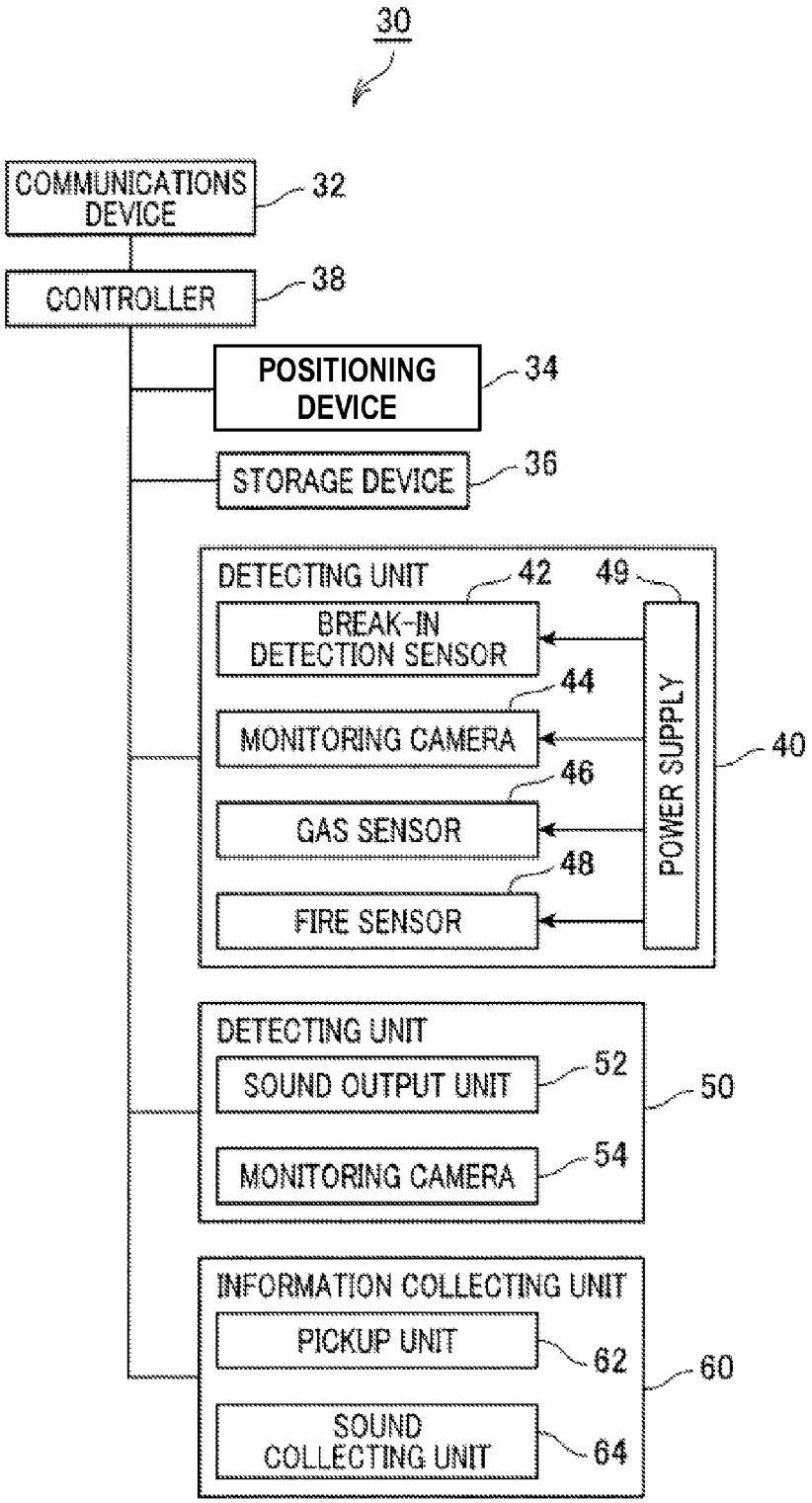
FIG. 3 is a block diagram schematically illustrating an example of the structure of each security terminal illustrated in FIG. 1.

Referring to FIG. 3, each of the security terminals 30 is comprised of a communications device 32, a positioning device 34, a storage device 36, a detecting unit 40, a warming unit 50, an information collecting unit 60, and a controller 38. The communication device 32 is communicably connected to the controller 38. The positioning device 34, the storage device 36, the detecting unit 40, the warming unit 50, the information collecting unit 60, and the controller 38 are communicably connected to each other through buses.

The communications device 32 is operative to perform radio communications, cable communications, or the combinations with at least the center terminal 10. The cable communications can use public networks or dedicated leased lines.

The positioning device 34 is operative to receive the location information provided by the positioning devices 3, and produce terminal location information indicative of the location of the corresponding security terminal 30. The terminal location information about a security terminal 30 includes, for example, the latitude and longitude of the security terminal 30, which shows the location thereof, and includes information indicative of the range of the corresponding monitored area WA of the security terminal 30.

As described above, the positioning device 34 produces terminal location information about the corresponding security terminal 30 as a function of the received location information sent from the positioning devices 3. For example, the positioning device 34 can be designed to produce the terminal location information about the corresponding security terminal 30 using, for example, known radio triangulation techniques based on the pieces of location information sent from some of the positioning devices 3 if they are GPS satellites. The positioning device 34 can also be designed to produce the terminal location information about the corresponding security terminal 30 using, for example, known positioning method based on the pieces of local information sent from some of the positioning devices 3 if they are mobile stations. For example, the positioning device 34 identifies the location of the corresponding security terminal 30 based on how the pieces of location information sent from some of the mobile stations are received thereby.

The detecting unit 40, which serves as a part of a first information collecting module, is operative to detect the environment of a corresponding target object, i.e. a corresponding target home, and the environment of the monitored area WA as object-situation information.

For example, referring to FIG. 3, the detecting unit 40 includes at least break-in detection sensors 42, at least one monitoring camera, i.e. at least one image sensor, 44, gas sensors 46, fire sensors 48, and a power supply 49 connected to the sensors 42, 44, 46, and 48.

Each break-in detection sensor 42 is designed to be activated, based on power supplied from the power supply 49 at predetermined first cycle, to check whether there is a break-in object into the corresponding target object or a corresponding section in the monitored area WA. In this embodiment, as an example, the break-in detection sensors 42 are available infrared sensors, each of which is equipped with a light emitting unit for emitting infrared light, and a light receiving unit for receiving the infrared light emitted from the light emitting unit. Each of the infrared detection sensors 42 has a predetermined emission region over which the infrared light emitted therefrom is irradiated. The infrared sensors 42 are arranged such that their emission regions cover the monitored area WA.

The at least one monitoring camera 44 is, for example, located in the corresponding target object. The at least one monitoring camera 44 is designed to be activated, based on power supplied from the power supply 49 at predetermined second cycle, to pick up images of the monitored area WA and output the picked-up images of the monitored area WA to the controller 38.

Each gas sensor 46 is a known gas sensor that is activated, based on power supplied from the power supply 49 at predetermined third cycle, to check whether there is gas leakage in the corresponding target object. Each fire sensor 48 is a known fire sensor that is activated, based on power supplied from the power supply 49 at predetermined fourth cycle, to check whether there is a fire in the corresponding target object. If the target object of each of the security terminals 30 is a target home, the gas sensors 46 are, for example, placed in the respective rooms of the target home, and similarly, the fire sensors 48 are, for example, placed in the respective rooms thereof.

Specifically, if the light receiving unit of an infrared sensor 42 does not detect the infrared light due to the interception of the infrared light thereto by a break-in object, the light receiving unit detects the existence of the break-in object, and outputs the object-situation information about the occurrence a break-in in the monitored area WA to the controller 38. Otherwise, if the light receiving unit of an infrared sensor 42 detects the infrared light, the light receiving unit outputs no information to the controller 38, which can be regarded as output of the object-situation information such that no break-in objects have been detected in the monitored area WA.

As described above, the at least one monitoring camera 44 outputs picked-up images of the monitored area WA to the controller 38 as the object-situation information.

If a gas sensor 46 detects gas leakage in the corresponding target object based on the check, the gas sensor 46 outputs the occurrence of gas leakage to the controller 38 as the object-situation information. Otherwise, if a gas sensor 46 detects no gas leakage in the corresponding target object based on the check, the gas sensor 46 outputs no information to the controller 38, which can be regarded as output of information about no gas leakage having been detected in the corresponding target object as the object-situation information.

If a fire sensor 48 detects a fire in the corresponding target object based on the check, the fire sensor 48 outputs the occurrence of a fire to the controller 38 as the object-situation information. Otherwise, if a fire sensor 48 detects no fires in the corresponding target object based on the check, the fire sensor 48 outputs no information to the controller 38, which can be regarded as output of info Illation about no fires having been detected in the corresponding target object as the object-situation information.

The warning unit 50, which serves as, for example, a part of an alarm module, is designed to set off an alarm based on control of the controller 38 if the controller 38 determines that there is an abnormal situation associated with the corresponding target object or the monitored area WA. The warning unit 50 is, for example, equipped with a sound output unit 52 and a light emitting unit 54.

The sound output unit 52 includes a speaker and is operative to output an alarm in response to an instruction sent from the controller 38. The light emitting unit 54 is operative to emit warning light in response to an instruction sent from the controller 38.

The information collecting unit 60, which serves as, for example, a part of the first information collecting module, is operative to collect information about the environment of the monitored area WA as area-situation information, and operative to output the collected area-situation information to the controller 38. The information collecting unit 60 is, for example, equipped with at least one pickup unit 62 and at least one sound collecting unit 64.

The at least one pickup unit 62 is, for example, located in the monitored area WA and operative to pick up images of at least part of the monitored area WA. The at least one pickup unit 62 is operative to output the picked-up images to the controller 38 as the area-situation information. The at least one sound collecting unit 64 is located in the monitored area WA. The at least one sound collecting unit 64 includes a microphone and is operative to collect sounds in the monitored area WA. The at least one sound collecting unit 64 is operative to output the collected sounds to the controller 38 as the area-situation information.

Note that the object-situation information collected by the detecting unit 40 and the area-situation information collected by the information collecting unit 60, which are output to the controller 38, as target-object information associated with the monitored area WA including the corresponding target object.

The controller 38, which serves as, for example, a part of each of the first information collecting module and the alarm module, is designed as a device based on a normal microcomputer comprised of a ROM, a RAM, a CPU, and so on. The controller 38 is operative to control the communications device 32, the positioning device 34, the storage device 36, the detecting unit 40, the warning unit 50, and the information collecting unit 60.

The storage device 36 is designed as a rewritable non-volatile memory. In the storage device 36, the monitored-area information indicative of the location, shape and size of the monitored area WA for the corresponding target object is stored set forth above. In the storage device 36, various programs that the controller 38 runs are also stored.

The various programs include a communication program that causes the controller 38 to perform a communication task to perform communications between the corresponding security terminal 30 and the center terminal 10.

The various programs also include an area monitoring program that causes the controller 38 to perform an area monitoring task. The area monitoring task is designed to:

determine whether there is an abnormal situation associated with the corresponding target object or the monitored area WA; and instruct the warning unit 50 to output a warning upon determining that there is an abnormal situation associated with the corresponding target object or the monitored area WA.

Figure 4:
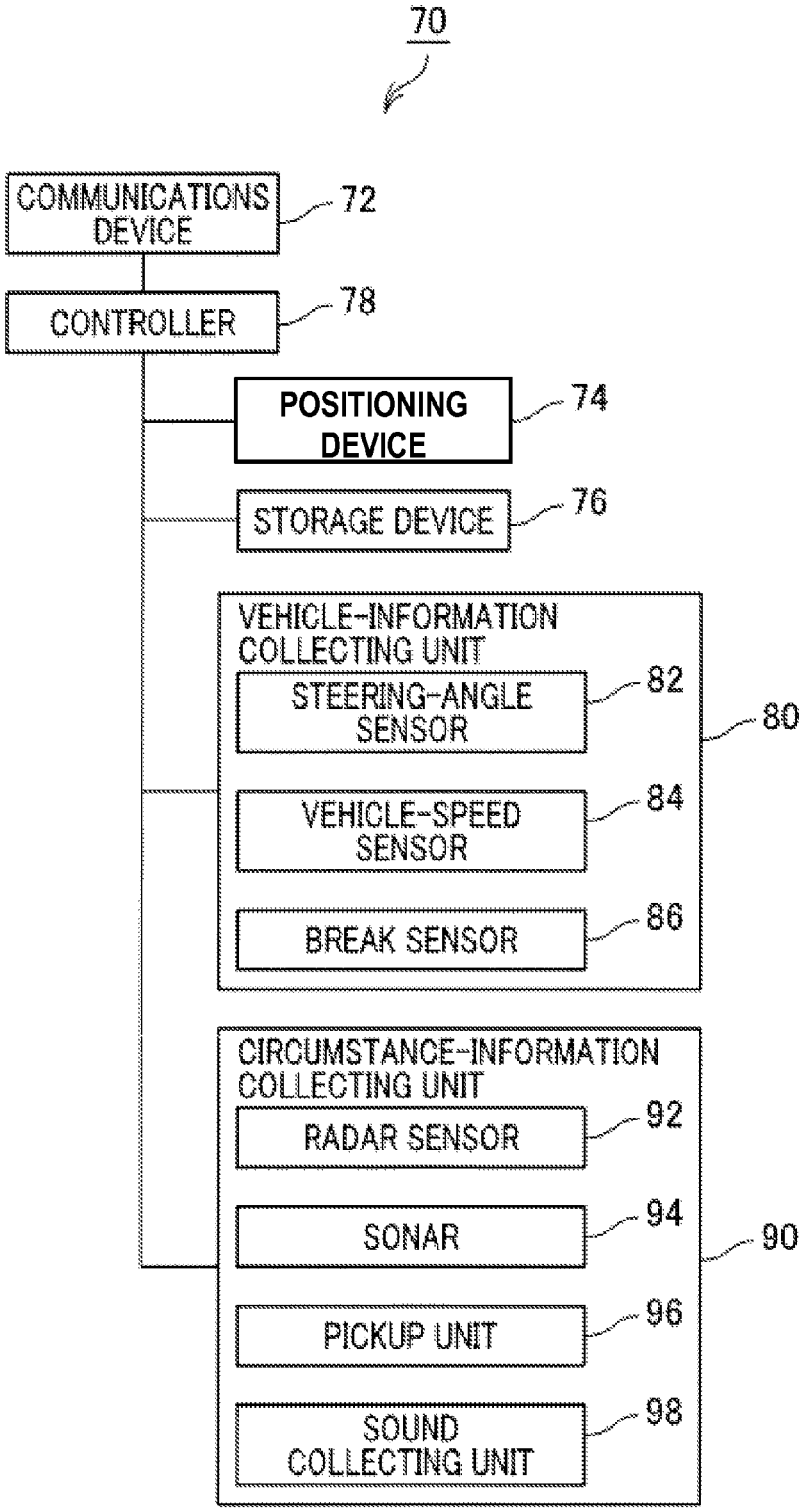
FIG. 4 is a block diagram schematically illustrating an example of the structure of mobile terminal illustrated in FIG. 1.

Referring to FIG. 4, each of the mobile terminals 70 is comprised of a communications device 72, a positioning device 74, a storage device 76, a vehicle-information collecting unit 80, a circumstance-information collecting unit 90, and a controller 78. The communication device 72 is communicably connected to the controller 78. The positioning device 74, the storage device 76, the vehicle-information collecting unit 80, the circumstance-information collecting unit 90, and the controller 78 are communicably connected to each other through buses.

The communications device 72 is operative to perform communications with at least the center terminal 10.

The positioning device 74 is operative to receive the location information provided by the positioning devices 3, and produce terminal location information indicative of the location of the corresponding mobile terminal 70. As described above, the positioning device 74 produces terminal location information about the corresponding mobile terminal 70 as a function of the received location information sent from the positioning devices 3. For example, the positioning device 74 can be designed to produce the terminal location information about the corresponding mobile terminal 70 using, for example, known radio triangulation techniques based on the pieces of location information sent from some of the positioning devices 3 if they are GPS satellites. The positioning device 74 can also be designed to produce the terminal location information about the corresponding mobile terminal 70 using, for example, known positioning method based on the pieces of local information sent from some of the positioning devices 3 if they are mobile stations. For example, the positioning device 74 identifies the location of the corresponding mobile terminal 70 based on how the pieces of location information sent from some of the mobile stations are received thereby.

The vehicle-information collecting unit 80, which serves as, for example, a first circumstance information obtaining module of a second information collecting module, is operative to collect information indicative of the behavior of the corresponding motor vehicle as behavior information, and operative to output the collected behavior information to the controller 78. The vehicle-information collecting unit 80 is, for example, equipped with at least a steering-angle sensor 82 provided for each front wheel of the corresponding motor vehicle, a vehicle speed sensor 84, and a brake sensor 86 provided for each wheel.

Each steering-angle sensor 82 is operative to measure a current steering angle of a corresponding front wheel.

The vehicle speed sensor 84 is operative to measure the speed of the vehicle, and operative to output, to the controller 78, the measured speed of the vehicle, referred to as a vehicle speed.

Each brake sensor 86 is operative to measure how a brake system installed in the corresponding motor vehicle works to brake the corresponding motor vehicle.

Specifically, the vehicle-information collecting unit 80 collects the results measured by each steering-angle sensor 82, the results measured by the vehicle speed sensor 84, and the results measured by the brake sensors 86 as the behavior information about the corresponding motor vehicle. The vehicle-information collecting unit 80 also outputs the collected behavior information about the corresponding motor vehicle to the controller 78.

The circumstance-information collecting unit 90, which serves as, for example, a second circumstance information obtaining module of the second information collecting module, is operative to collect information indicative of the circumstances around the corresponding motor vehicle as mobile-terminal circumstance information, and operative to output the collected mobile-terminal circumstance information to the controller 78. The circumstance-information collecting unit 90 is, for example, equipped with at least one radar sensor 92, at least one sonar 94, at least one pickup unit 96, and at least one sound collecting unit 98.

The at least one radar sensor 92 is operative to transmit probing waves, such as radar waves and laser waves, and receive echoes based on the transmitted probing waves. Based on the received echoes, the at least one radar sensor 92 is operative to detect at least one object existing around the corresponding motor vehicle.

The at least one sonar 94 is operative to transmit probing waves, such as sound waves and ultrasonic waves, and receive echoes based on the transmitted probing waves. Based on the received echoes, the at least one sonar 94 is operative to detect at least one object existing around the corresponding motor vehicle.

The at least one pickup unit 96 is operative to pick up images of the environments around the corresponding motor vehicle. The at least one sound collecting unit 98 includes a microphone and is operative to collect sounds around the corresponding motor vehicle.

Specifically, the circumstance-information collecting unit 90 collects the results measured by the at least one radar sensor 92, the results measured by the at least one sonar 94, the images picked-up by the at least one pickup unit 96, and the sounds collected by the at least one sound collecting unit 98 as the mobile-terminal circumstance information about the corresponding mobile vehicle 70. The circumstance-information collecting unit 90 also outputs the collected mobile-terminal circumstance information about the corresponding mobile vehicle to the controller 78.

The controller 78, which serves as, for example, a part of the second information collecting module, is designed as a device based on a normal microcomputer comprised of a ROM, a RAM, a CPU, and so on. The controller 78 is operative to control the communications device 72, the positioning device 74, the storage device 76, the vehicle-information collecting unit 80, and the circumstance-information collecting unit 90.

The storage device 76 is designed as a rewritable non-volatile memory. In the storage device 76, various programs that the controller 78 runs are stored. The various programs include a first circumstance monitoring program that causes the controller 78 to perform a first circumstance monitoring task. The first circumstance monitoring task is designed to, if the corresponding motor vehicle exists in the surrounding area AA, collect the behavior information and the mobile-terminal circumstance information via the respective vehicle-information collecting unit 80 and circumstance-information collecting unit 90. The first circumstance monitoring task is also designed to send the collected mobile-terminal circumstance information and behavior information to the center terminal 10.

Figure 5:
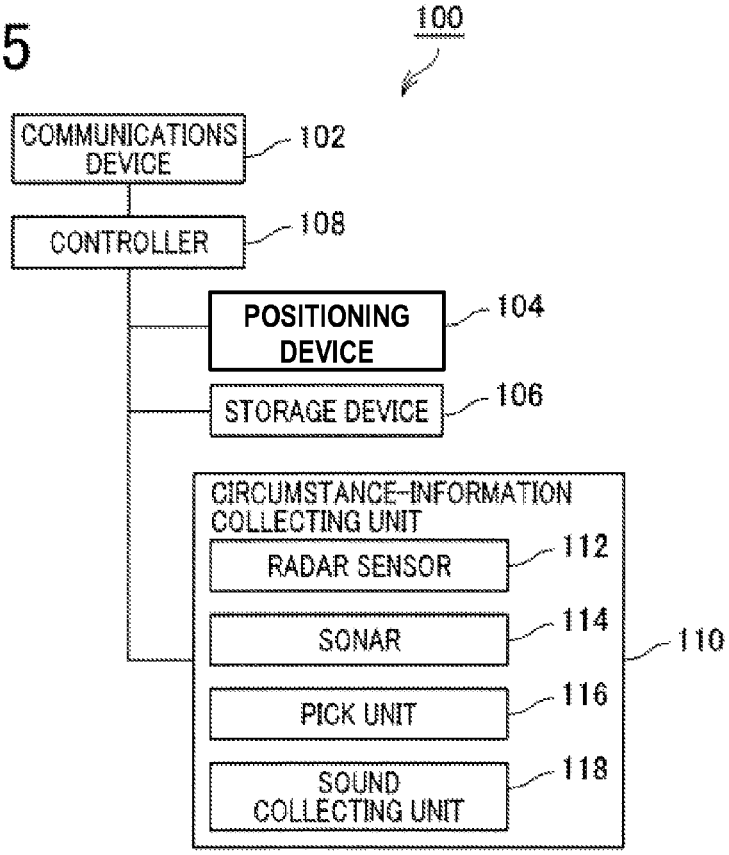
FIG. 5 is a block diagram schematically illustrating an example of the structure of each on-road terminal illustrated in FIG. 1.

Referring to FIG. 5, each of the on-road terminals 100 is comprised of a communications device 102, a positioning device 104, a storage device 106, a circumstance-information collecting unit 110, and a controller 108. The communication device 102 is communicably connected to the controller 108. The positioning device 104, the storage device 106, the circumstance-information collecting unit 110, and the controller 108 are communicably connected to each other through buses.

The communications device 102 is operative to perform radio communications, cable communications, or the combinations with at least the center terminal 10. The cable communications can use public networks or dedicated leased lines.

The positioning device 104 is operative to receive the location information provided by the positioning devices 3, and produce terminal location information indicative of the location of the corresponding on-road terminal 100. As described above, the positioning device 104 produces terminal location information about the corresponding on-road terminal 100 as a function of the received location information sent from the positioning devices 3. For example, the positioning device 104 can be designed to produce the terminal location information about the corresponding on-road terminal 100 using, for example, known radio triangulation techniques based on the pieces of location information sent from some of the positioning devices 3 if they are GPS satellites. The positioning device 104 can also be designed to produce the terminal location information about the corresponding on-road terminal 100 using, for example, known positioning method based on the pieces of local information sent from some of the positioning devices 3 if they are mobile stations. For example, the positioning device 104 identifies the location of the corresponding on-road terminal 100 based on how the pieces of location information sent from some of the mobile stations are received thereby.

The circumstance-information collecting unit 110, which serves as, for example, a part of the second information collecting module, is operative to collect information indicative of the circumstances around the location of the corresponding on-road terminal 100 as on-road circumstance information, and operative to output the collected on-road circumstance information to the controller 108. The circumstance-information collecting unit 110 is, for example, equipped with at least one radar sensor 112, at least one sonar 114, at least one pickup unit 116, and at least one sound collecting unit 118.

The at least one radar sensor 112 is operative to transmit probing waves, such as radar waves and laser waves, and receive echoes based on the transmitted probing waves. Based on the received echoes, the at least one radar sensor 112 is operative to detect at least one object existing around the location of the corresponding on-road terminal.

The at least one sonar 114 is operative to transmit probing waves, such as sound waves and ultrasonic waves, and receive echoes based on the transmitted probing waves. Based on the received echoes, the at least one sonar 114 is operative to detect at least one object existing around the location of the corresponding on-road terminal.

The at least one pickup unit 116 is operative to pick up images of the environments around the corresponding on-road terminal 100. The at least one sound collecting unit 118 includes a microphone and is operative to collect sounds around the corresponding on-road terminal 100.

Specifically, the circumstance-information collecting unit 110 collects the results measured by the at least one radar sensor 112, the results measured by the at least one sonar 114, the images picked-up by the at least one pickup unit 116, and the sounds collected by the at least one sound collecting unit 118 as the on-road circumstance information about the corresponding on-road terminal 100. The circumstance-information collecting unit 110 also outputs the collected on-road circumstance information about the corresponding on-road terminal 100 to the controller 108.

The controller 108, which serves as, for example, a part of the second information collecting module, is designed as a device based on a normal microcomputer comprised of a ROM, a RAM, a CPU, and so on. The controller 108 is operative to control the communications device 102, the positioning device 104, the storage device 106, and the circumstance-information collecting unit 110.

The storage device 106 is designed as a rewritable non-volatile memory. In the storage device 106, various programs that the controller 108 runs are stored. The various programs include a second circumstance monitoring task that causes the controller 108 to perform a second circumstance monitoring task. The second circumstance monitoring task is designed to collect the road-circumstance information via the circumstance-information collecting unit 110. The second circumstance monitoring task is also designed to send the collected on-road circumstance information to the center terminal 10.

Next, the communication task carried out by the controller 38 of each security terminal 30 in accordance with the communication program stored in the storage device 36 will be described hereinafter. The controller 38 of each security terminal 30 runs the communication task based on the communication program each time power supply is started to the corresponding security terminal 30.

Figure 6:
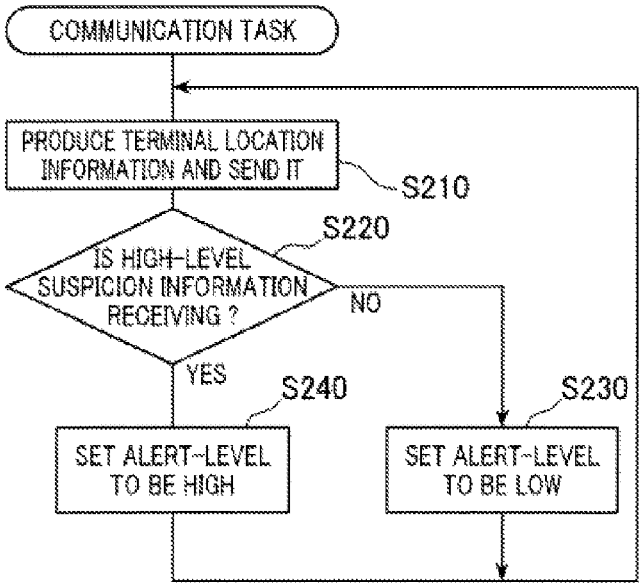
FIG. 6 is a flowchart schematically illustrating an example of a communication task carried out by each security terminal illustrated in FIG. 1.

Referring to FIG. 6, when the communication task is run, the controller 38 of each security terminal 30 instructs the positioning device 34 to produce the terminal location information indicative of the location of the corresponding security terminal 30 in step S210. Then, in step S210, the controller 38 sends, to the center terminal 10, the terminal location information with the corresponding ID assigned to the corresponding security terminal 30.

Next, the controller 38 determines whether it is currently receiving high-level suspicion information from the center terminal 10 in step S220. The high-level suspicion information means information indicating that there is a high probability that a suspicious event associated with the corresponding target object or the monitored area WA will occur.

Upon determination that the controller 38 is not currently receiving high-level suspicion information (NO in step S220), the controller 38 sets or maintains an alert-level flag, which is a bit of 0 or 1, to 0 in step S230.

The alert-level flag is stored beforehand in the controller 38 or the storage device 36. The alert-level flag shows the alert level for the corresponding target object and the monitored area WA. Specifically, the alert-level flag being set to 1 shows that the alert level for the corresponding target object and the monitored area WA is high, and the alert-level flag being set to 0 shows that the alert level for the corresponding target object and the monitored area WA is low. An initial value of the alert-level flag is set to 0.

That is, in step S230, the controller 38 maintains the alert-level for the corresponding target object and the monitored area WA at the low level.

Otherwise, upon determination that the controller 38 is currently receiving high-level suspicion information (YES in step S220), the controller 38 sets or maintains the alert-level flag to 1, thus setting the alert-level for the corresponding target object and the monitored area WA at the high level in step S240. Thereafter, the controller 38 returns to perform the communication task from the operation in step S210 again. In other words, the controller 38 cyclically performs the communication task from the operation in step S210 to the operation in step S230 or S240.

Specifically, each security terminal 30 is programmed to perform the communication task that:

cyclically sends, to the center terminal 10, the terminal location information produced by the positioning device 34 as information indicative of the corresponding security terminal 30 is operating, the information-sending cycle being set to a predetermined length of time; and sets the alert-level flag to 1 showing that the alert level for the corresponding target object and the monitored area WA is high for the periods during which the security terminal 30 is receiving high-level suspicion information.

Next, the area monitoring task carried out by the controller 38 of each security terminal 30 in accordance with the area monitoring program stored in the storage device 36 will be described hereinafter. The controller 38 of each security terminal 30 runs the area monitoring task based on the area monitoring program each time power supply is started to the corresponding security terminal 30.

Figure 7:
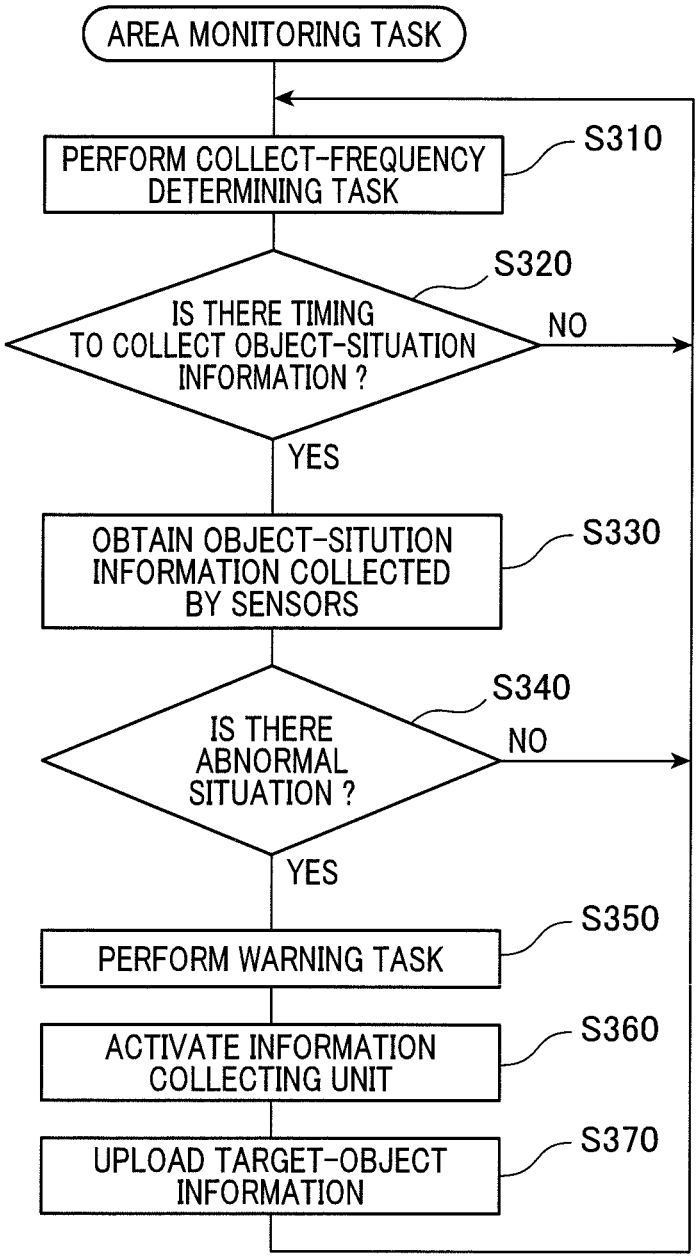
FIG. 7 is a flowchart schematically illustrating an example of an area monitoring task carried out by each security terminal illustrated in FIG. 1.

Referring to FIG. 7, the area monitoring task is run, the controller 38 of each security terminal 30 performs a sampling-frequency determining task based on the current value of the alert-level flag in step S310.

The sampling-frequency determining task is designed to determine the sampling frequency at which the controller 38 acquires, from each of the sensors 42, 44, 46, and 48, corresponding object-situation information.

For example, in this embodiment, the sampling frequency of the controller 38 for each of the sensors 42, 44, 46, and 48 is determined to be synchronized with the frequency at which a corresponding one of the sensors 42, 44, 46, and 48 collects corresponding object-situation information. Thus, the collect-frequency determining task is designed to determine:

a value of the first collection frequency at which each break-in sensor 42 is activated to collect the object-situation information about whether there is a break-in object into the corresponding target object or a corresponding section of the monitored area WA;

a value of the second collection frequency at which the at least one monitoring camera 44 is activated to obtain the object-situation information indicative of image information about the monitored area WA;

a value of the third collection frequency at which each gas sensor 46 is activated to obtain the object-situation information about whether there is gas leakage in the corresponding target object; and a value of the fourth collection frequency at which each fire sensor 48 is activated to obtain the object-situation information about whether there is a fire in the corresponding target object.

Specifically, if the current value of the alert-level flag is set to 1 so that the alert level is high, the controller 38 determines that a value of each of the first to fourth collection cycles is higher than a preset normal value thereof as an initial value. Otherwise, if the current value of the alert-level flag is set to 0 so that the alert level is low, the controller 38 maintains each of the first to fourth collection cycles at the corresponding normal value. The operations in steps S220 to S240, and the operation in step S310 serve as, for example, the controlling module.

Following the operation in step S310, the controller 38 determines whether there is timing, based on the determined sampling frequency, to sample, from each of the sensors 42, 44, 46, and 48, corresponding object-situation information in step S320.

Specifically, in step S320, the controller 38 determines whether there is timing when each of the sensors 42, 44, 46, and 48 collects the corresponding object-situation information.

Upon determination that there is not timing when each of the sensors 42, 44, 46, and 48 collects the corresponding object-situation information (NO in step S320), the controller 38 returns to perform the area monitoring task from the operation in step S310 again. In other words, the controller 38 cyclically performs the area monitoring task from the operation in step S310.

Otherwise, upon determination that there is timing when each of the sensors 42, 44, 46, and 48 obtains the corresponding object-situation information (YES in step S320), the controller 38, which serves as, for example, the first information collecting module, collects the object-situation information as the target-object information each time the object-information is collected by each of the sensors 42, 44, 46, and 48 at a corresponding one of the first to fourth cycles in step S330.

Following the operation in step S330, the controller 38 determines, in step S340, whether there is an abnormal situation associated with the corresponding target object or the monitored area WA based on the target-object information collected in step S330.

For example, the conditions required for the controller 38 to determine that there is an abnormal situation associated with the corresponding target object or the monitored area WA include the following conditions:

the first condition that a break-in object into the corresponding target object or the monitored area WA is detected by a break-in detection sensor 42;

the second condition that it is determined, based on the results of image processing on the images picked-up by the at least one monitoring camera 44, a suspicions person breaks into the monitored area WA;

the third condition that gas leakage in the corresponding target object is detected by a gas sensor 46; and the fourth condition that a fire in the corresponding target object is detected by a fire sensor 48.

Specifically, upon determination that there are no abnormal situations associated with the corresponding target object or the monitored area WA (NO in step S340), the controller 38 returns to perforin the area monitoring task from the operation in step S310 again. Otherwise, upon determination that there is at least one abnormal situation associated with the corresponding target object or the monitored area WA (YES in step S340), the controller 38 carries out a warning task in step S350.

For example, the warning task in step S350 drives the warning unit 50 so that the warning unit 50 outputs a warning.

Specifically, in step S350, the controller 38 causes, as the warning task, the sound output unit 52 to output an alarm that warns someone existing in the monitored area WA, and/or causes the light emitting unit 54 to emit warning light that warns someone existing in the monitored area WA.

As another example, in step S350, the controller 38 causes, as the warning task, the sound output unit 52 to output sound information and/or the light emitting unit 54 to emit light information; the output sound or light information informs someone existing around the monitored area WA of the occurrence of an abnormal situation. As a further example, in step S350, the controller 38 sends, to a mobile terminal that an owner of the corresponding target object has, information about the occurrence of an abnormal situation associated with the monitored area WA. The operations in steps S340 and S350 serve as, for example, the alarm module.

Following the operation in step S350, the controller 38 activates the information collecting unit 60, so that the at least one pickup unit 62 picks up images of at least part of the monitored area WA as the area-situation information, and the at least one sound collecting unit 64 collects sounds in the monitored area WA as the area-situation information in step S360. Then, in step S360, the controller 38 obtains the area-situation information collected by the at least one pickup unit 62 and the at least one sound collecting unit 64 as the target-object information. Note that, in step S360, the controller 38 adds the object-situation information collected in step S330 to the obtained area-situation information as the target-object information.

Following the operation in step S360, the controller 38 sends the target-object information obtained in step S360 to the center terminal 10, thus uploading the target-object information to the center terminal 10 in step S370. Thereafter, the controller 38 returns to perform the area monitoring task from the operation in step S310 again.

Specifically, each security terminal 30 is programmed to perform the area monitoring task that:

determine that a value of each of the first to fourth cycles at which a corresponding sensor of the detecting unit 40 obtains the corresponding object-situation information is higher than the preset normal value if the current value of the alert-level flag is set to 1;

collect the corresponding object-situation information as the target-object information each time the object-information is collected by each sensor at a corresponding one of the first to fourth cycles;

determine whether there is an abnormal situation associated with the corresponding target object or the monitored area WA based on the collected target-object information; and drive the warning unit 50 to output a warning and upload the target-object information collected by the information collecting unit 60 to the center terminal 10 if it is determined that there is an abnormal situation associated with the corresponding target object or the monitored area WA.

Next, the first circumstance monitoring task carried out by the controller 78 of each mobile terminal 70 in accordance with the first circumstance monitoring program stored in the storage device 76 will be described hereinafter. The controller 78 of each mobile terminal 70 runs the first circumstance monitoring task based on the first circumstance monitoring program each time power supply is started to the corresponding mobile terminal 70.

Figure 8:
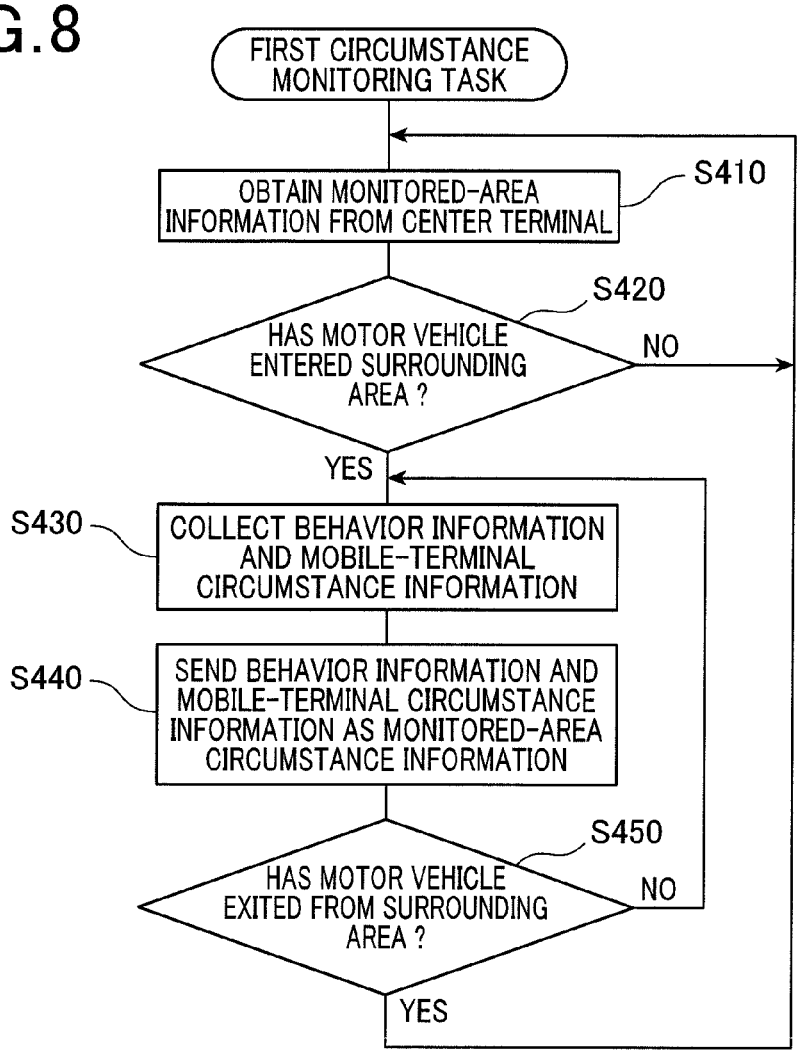
FIG. 8 is a flowchart schematically illustrating an example of a first circumstance monitoring task carried out by each mobile terminal illustrated in FIG. 1.

Referring to FIG. 8, when the first circumstance monitoring task is run, the controller 78 of each mobile terminal 70 obtains, from the center terminal 10, the monitored-area information for at least one currently monitoring security terminal 30 described later; the monitored-area information for the at least one currently monitoring security terminal 30 includes the terminal location information thereabout in step S410. The operation in step S410 serves as, for example, a part of the second information collecting module.

Next, the controller 78 determines whether the motor vehicle incorporating therein the corresponding mobile terminal 70 has entered the surrounding area AA defined by the monitored-area information for the at least one currently monitoring security terminal 30 in step S420. Specifically, in step S420, the controller 78 checks the terminal location information about the corresponding mobile terminal 70 produced by the positioning device 74 against the location of the surrounding area AA defined by the monitored-area information for the at least one currently monitoring security terminal 30. As the checked results, if it is determined that the terminal location information about the corresponding mobile terminal 70 is within the location of the surrounding area AA defined by the monitored-area information for the at least one currently monitoring security terminal 30, the controller 78 determines that the corresponding motor vehicle has entered the surrounding area AA defined by the monitored-area information for the at least one currently monitoring security terminal 30 in step S420.

Upon determination that the corresponding motor vehicle has not entered the surrounding area AA defined by the monitored-area information for the at least one currently monitoring security terminal 30 (NO in step S420), the controller 78 returns to perform the first circumstance monitoring task from the operation in step S410 again. In other words, the controller 78 cyclically performs the first circumstance monitoring task from the operation in step S410.

Otherwise, upon determination that the corresponding motor vehicle has entered the surrounding area AA defined by the monitored-area information for the at least one currently monitoring security terminal 30 (YES in step S420), the controller 78 of the mobile terminal 70 of the corresponding motor vehicle carries out the operation in step S430.

In step S430, the controller 78, which determined that the corresponding motor vehicle has entered the surrounding area AA, instructs the vehicle-information collecting unit 80 to collect the behavior information about the corresponding motor vehicle located within the surrounding area AA. In step S430, the controller 78, which determined that the corresponding motor vehicle has entered the surrounding area AA, also instructs the circumstance-information collecting unit 90 to collect the mobile-terminal circumstance information around the corresponding motor vehicle located within the surrounding area AA. Then, the controller 78 sends, to the center terminal 10, the collected behavior information and the mobile-terminal circumstance information as the monitored-area circumstance information in step S440.

Next, the controller 78, which determined that the corresponding motor vehicle has entered the surrounding area AA, determines whether the corresponding motor vehicle has exited from the surrounding area AA in step S450.

Upon determination that the corresponding motor vehicle has not exited from the surrounding area AA (NO in step S450), the controller 78 returns to carry out the operation in step S430 again. Otherwise, upon determination that the corresponding motor vehicle has exited from the surrounding area AA (YES in step S450), the controller 78 returns to perform the first circumstance monitoring task from the operation in step S410 again.

That is, each mobile terminal 70 is programmed to perform the first circumstance monitoring task that:

causes the vehicle-information collecting unit 80 and the circumstance-information collecting unit 90 to collect the respective behavior information and the mobile-terminal circumstance information if the corresponding motor vehicle has entered the surrounding area AA; and sends, to the center terminal 10, the collected behavior information and the circumstance information as the monitored-area circumstance information.

Next, the second circumstance monitoring task carried out by the controller 108 of each on-road terminal 100 in accordance with the second circumstance monitoring program stored in the storage device 106 will be described hereinafter. The controller 108 of each on-road terminal 100 runs the second circumstance monitoring task based on the second circumstance monitoring program each time power supply is started to the corresponding on-road terminal 100.

Figure 9:
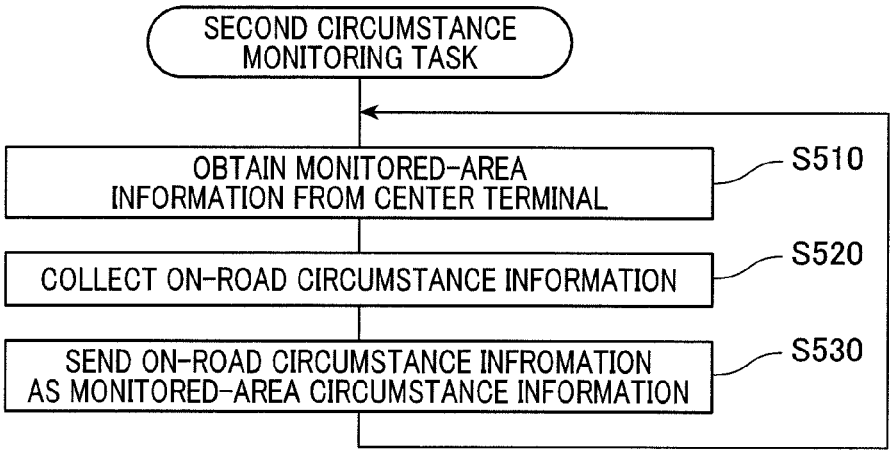
FIG. 9 is a flowchart schematically illustrating an example of a second circumstance monitoring task carried out by each on-road terminal illustrated in FIG. 1.

Referring to FIG. 9, when the second circumstance monitoring task is run, the controller 108 of each on-road terminal 100 obtains, from the center terminal 10, the monitored-area information for at least one currently monitoring security terminal 30; the monitored-area information for the at least one currently monitoring security terminal 30 includes the terminal location information thereabout in step S510. The operation in step S510 serves as, for example, a part of the second information collecting module.

Next, if the corresponding on-road terminal 100 is located within the surrounding area AA defined by the monitored-area information for the at least one currently monitoring security terminal 30, the controller 108 of the corresponding on-road terminal 100 instructs the circumstance-information collecting unit 110 to collect the road-circumstance information around the corresponding on-load terminal 100 located within the surrounding area AA in step S520. Then, the controller 108 sends, to the center terminal 10, the collected on-road circumstance information as the monitored-area circumstance information in step S530.

Following the operation in step S530, the controller 108 returns to perform the second circumstance monitoring task from the operation in step S510 again. In other words, the controller 108 cyclically performs the second circumstance monitoring task from the operation in step S510.

That is, each on-road terminal 100 is programmed to perform the second circumstance monitoring task that:

causes the circumstance-information collecting unit 110 to collect the on-road circumstance information if the corresponding on-road terminal 100 is located within the surrounding area AA; and sends, to the center terminal 10, the collected on-road circumstance information as the monitored-area circumstance information.

Next, the area management task carried out by the center terminal 10 in accordance with the area management program stored in the storage device 16 will be described hereinafter. The controller 18 of the center terminal 10 runs the area management task based on the area management program each time power supply is started to the center terminal 10.

Figure 10:
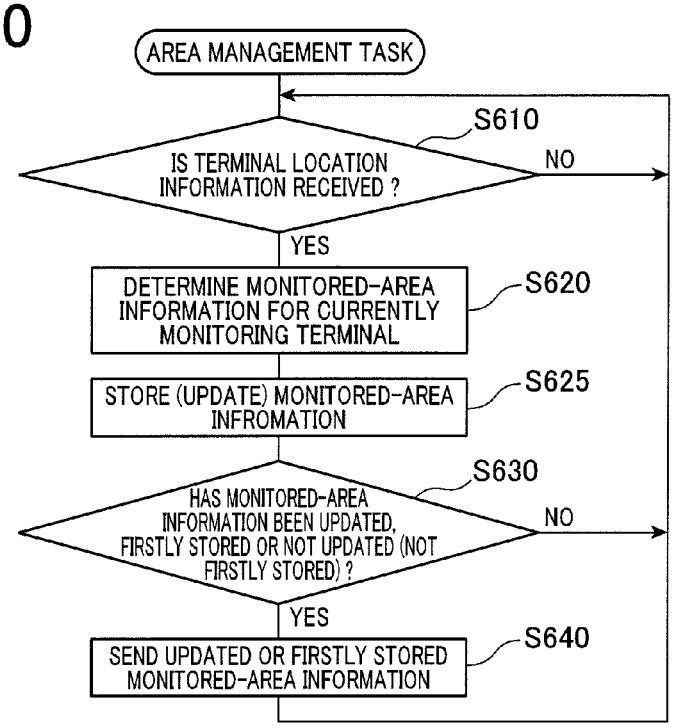
FIG. 10 is a flowchart schematically illustrating an example of an area management task carried out by a center terminal illustrated in FIG. 1.

Referring to FIG. 10, when the area management task is run, the controller 18 of the center terminal 10 determines whether it is currently receiving, from at least one security terminal 30, the terminal location information about the at least one security terminal 30 in step S610. Upon determination that the controller 18 is not currently receiving the terminal location information from each security terminal 30 (NO in step S610), the controller 18 returns to perform the area management task from the operation in step S610 again. In other words, the controller 18 cyclically performs the area management task from the operation in step S610.

Otherwise, upon determination that the controller 18 is currently receiving the terminal location information from at least one security terminal 30 (YES in step S610), the controller 18 identifies the at least one security terminal 30 as a currently monitoring security terminal 30 that is currently monitoring the corresponding target object and the monitored area WA. Then, the controller 30 stores, in the storage device 16, the terminal location information about the currently monitoring security terminal 30 to be correlative with the corresponding ID included in the terminal location information in step S620. In step S620, the controller 18 also deter wines the monitored-area information about the monitored area WA corresponding to the currently monitoring security terminal 30 using the terminal location information. Then, in step S625, the controller 18 stores, in the storage device 16, the monitored-area information about the monitored area WA corresponding to the currently monitoring security terminal 30 to be correlative with the corresponding ID.

Specifically, in step S625, if previous monitored-area information of a currently monitoring security terminal 30 has been stored in the storage device 16, the controller 18 updates the previous monitored-area information to the monitored-area information about the monitored area WA of the same security terminal 30 currently determined in step S620.

Note that the monitored-area information about the monitored area WA for each security terminal 30 can be determined in a corresponding security terminal 30, and sent from each security terminal 30 to the center terminal 10 together with the terminal location information about a corresponding one of the security terminal 30 in step S210.

Following the operation in step S625, the controller 18 determines whether monitored-area information for at least one currently monitoring security terminal 30 stored in the storage device 16 has been updated or has been firstly stored in step S625 or not in step S630.

Upon determination that monitored-area information for all the currently monitoring security terminal(s) 30 stored in the storage device 16 has not been updated or has not been firstly updated (NO in step S630), the controller 18 returns to perform the area management task from the operation in step S610 again.

Otherwise, upon determination that monitored-area information for at least one currently monitoring security terminal 30 stored in the storage device 16 has been updated or has been firstly updated (YES in step S630), the controller 18 performs the operation in step S640. In step S640, the controller 18 sends the updated or firstly stored monitored-area information with the corresponding ID to each of the mobile terminals 70 and the on-road terminals 100. Thereafter, the controller 18 returns to perform the area management task again from the operation in step S610.

That is, the center terminal 10 is programmed to perform the area management task that:

registers at least one security terminal 30, which has transmitted the terminal location information in the storage device 16 as at least one currently monitoring security terminal 30;

determines the monitored-area information about the monitored area WA corresponding to the currently registered security terminal 30; and send, to each of the mobile terminals 70 and each of the on-road terminals 100.

Next, the abnormal-situation probability calculating task carried out by the center terminal 10 in accordance with the abnormal-situation probability calculating program stored in the storage device 16 will be described hereinafter. The controller 18 of the center terminal 10 runs the abnormal-situation probability calculating task based on the abnormal-situation probability calculating program each time power supply is started to the center terminal 10. The controller 18, which performs the abnormal-situation probability calculating task, serves as, for example, the abnormal situation determining module.

Figure 11:
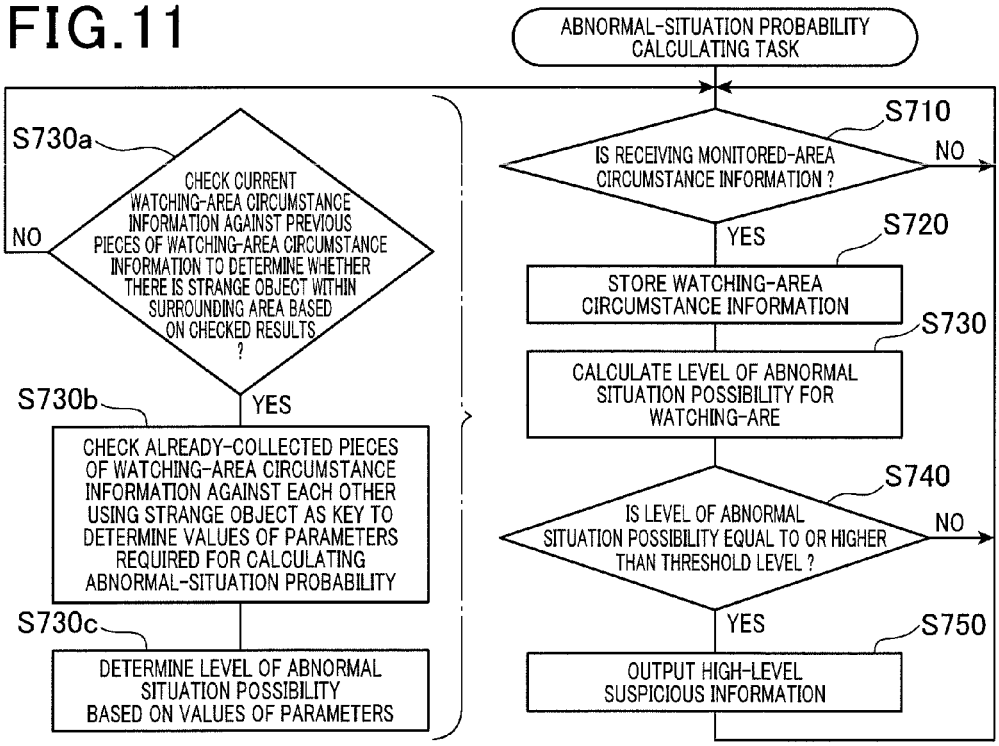
FIG. 11 is a flowchart schematically illustrating an example of an abnormal-situation probability calculating task carried out by the center terminal illustrated in FIG. 1.

Referring to FIG. 11, when the abnormal-situation probability calculating task is run, the controller 18 of the center terminal 10 determines whether it is currently receiving the monitored-area circumstance information from either: at least one mobile terminal 70 located within a surrounding area AA defined by the monitored-area information for at least one currently monitoring security terminal 30; or at least one on-road terminal 100 located within a surrounding area AA defined by the monitored-area information for at least one currently monitoring security terminal 30 in step S710.

Upon determination that the controller 18 is not currently receiving the monitored-area circumstance information from at least one mobile terminal 70 or at least one on-road terminal 100 (NO in step S710), the controller 18 returns to perform the suspicion-level calculating task from the operation in step S710 again. In other words, the controller 18 cyclically performs the suspicion-level calculating task from the operation in step S710.

Otherwise, upon determination that the controller 18 is currently receiving the monitored-area circumstance information from at least one mobile terminal 70 or at least one on-road terminal 100 (YES in step S710), the controller 18 stores the monitored-area circumstance information in the storage device 16 in step S720.

Next, the controller 18 calculates the abnormal-situation probability for the monitored area WA corresponding to the monitored-area information for at least one currently monitoring security terminal 30 in step S730.

Specifically, the controller 18 calculates the abnormal-situation probability for the monitored area WA corresponding to the monitored-area information for at least one currently monitoring security terminal 30; the abnormal-situation probability represents a probability that an abnormal situation associated with the monitored areas WA will occur in step S730.

How to specifically calculate the abnormal-situation probability for the monitored area WA corresponding to the monitored-area information for at least one currently monitoring security terminal 30 in step S730 will be described hereinafter.

Let us assume that, as described above, the abnormal-situation probability calculating task has been cyclically performed by the controller 18. The monitored-area circumstance information, which is stored in step S720 of a current cycle of the abnormal-situation probability calculating task, will be referred to as current monitored-area circumstance information. In addition, pieces of the monitored-area circumstance information, which have been stored in step S720 of the previous cycles of the abnormal-situation probability calculating task, will be referred to as previous pieces of monitored-area circumstance information. The current monitored-area circumstance information and the previous pieces of monitored-area circumstance information will be referred to as already-collected pieces of monitored-area circumstance information.

In this assumption, the controller 18 performs an operation to check the current monitored-area circumstance information against the previous pieces of monitored-area circumstance information to determine whether there is at least one strange object, such as a strange person or a strange vehicle within the surrounding area AA based on the checked results in step S730*a*.

Upon determination that there are no strange objects within the surrounding area AA (NO in step S730*a*), the controller 18 repeatedly performs the abnormal-situation probability calculating task from the operation in step S710. Thus, the controller 18 repeatedly performs the operation in step S730*a* each time the current monitored-area circumstance information is stored in step S720 of a current cycle of the abnormal-situation probability calculating task.

Otherwise, upon determination that there is at least one strange object, such as at least one strange person or vehicle within the surrounding area AA based on the checked results (YES in step S730*a*), the controller 18 performs the operation in step S730*b*.

Specifically, in step S730*b*, the controller 18 checks the already-collected pieces of monitored-area circumstance information against each other using the at least one strange object as a key. Then, the controller 18 calculates, based on the checked results, the abnormal-situation probability that the at least one strange object calculated in step S730*b* will cause an abnormal situation associated with the monitored area WA or the corresponding target object using, for example, the already collected pieces of monitored-area circumstance information.

In this embodiment, in step S730*b*, the controller 18 determines, based on the already collected pieces of monitored-area circumstance information and the at least one strange object, values of predetermined parameters required for calculating the abnormal-situation probability.

For example, the parameters are classified roughly into two groups. The first group includes some parameters used for short-term determination of whether the at least one strange object will cause an abnormal situation associated with the monitored area WA or the corresponding target object. The second group includes the remaining parameters used for long-term determination of whether the at least one strange object will cause an abnormal situation associated with the monitored area WA or the corresponding target object.

For example, the first to fourth parameters are included in the first group, and the fifth and sixth parameters are included in the second group.

The first parameter represents information indicative of how many times the at least one strange object has been determined as an at least one strange object. For example, the higher the number of times the at least one strange object has been determined as an at least one strange object is, the higher the value of the first parameter is.

The second parameter represents information indicative of the level of a sound output from the at least one strange object. For example, the higher the level of a sound output from the at least one strange object is, the higher the value of the second parameter is.

The third parameter represents information indicative of the degree of risk based on the location of the at least one strange object. For example, assuming that the at least one strange object is a strange vehicle, if the longer the period during which the strange vehicle has been parked or idling at a position on a road at which no vehicles have been normally parked or idling is, the higher the value of the third parameter is. As another example, if the at least one strange object is a strange person, the longer the period during which the strange person has hanged around within the surrounding area AA is, the higher the value of the third parameter is.

The fourth parameter represents information indicative of the degree of risk that the at least one strange object will cause crime. For example, assuming that the at least one strange object is a strange person, when the strange person has strange goods that normally persons may not have, the value of the fourth parameter is set to be a high value. As another example, assuming that the at least one strange object is a strange vehicle designed for carrying goods, such as a truck or a van, the longer the period during which a rear door of the strange vehicle has been opened, the higher the value of the fourth parameter is.

In addition, the fifth parameter represents information indicative of how long the at least one strange object has been monitored for a given long time, in other words, how many times the at least one strange object is monitored at a predetermined position within the surrounding area AA. For example, assuming that the at least one strange object is a strange vehicle, the longer the period during which the strange vehicle has been monitored is, the higher the value of the fifth parameter is.

The sixth parameter represents information indicative of how the at least one strange object travels within the surrounding area AA. For example, if the at least one strange object moves along an unlikely route within the surrounding area AA, the value of the sixth parameter is set to be a higher value.

Then, in step S730*c*, the controller 18 determines the abnormal-situation probability based on the values of the predetermined parameters determined in step S730*b*.

For example, in the storage device 16, information indicative of an evaluation function based on the predetermined parameters is stored beforehand. As a simple example of the evaluation function, the evaluation function is designed as the sum of the values of the predetermined parameters to which predetermined weighting coefficients have been respectively assigned. In this example, the controller 16 determines the sum of the values of the predetermined parameters to which predetermined weighting coefficients have been respectively assigned as the abnormal-situation probability in step S730*c*.

As another example, in step S730*b*, the controller 18 determines the abnormal-situation probability based on at least one of: an external feature of the at least one strange object; a positional relationship between the location of the at least one strange object and the monitored area WA; and a moving speed of the at least one strange object. Then, in step S730*c*, the controller 18 determines, based on the at least one of the external feature of the at least one strange object; the positional relationship between the location of the at least one strange object and the monitored area WA; and the moving speed of the at least one strange object, the abnormal-situation probability.

Following the operation in step S730, i.e. the operations in steps S730*a* to 730*c*, the controller 18 determines whether the abnormal-situation probability determined in step S730 is equal to or higher than a predetermined threshold level in step S740.

Upon determination that the abnormal-situation probability determined in step S730 is lower the threshold level (NO in step S740), the controller 18 returns to perform the suspicion-level calculating task of the next cycle from the operation in step S710 again.

Otherwise, upon determination that the abnormal-situation probability determined in step S730 is equal to or higher than the threshold level (YES in step S740), the controller 18 sends the high-level suspicion information to the corresponding at least one currently monitoring security terminal 30 in step S760. Thereafter, the controller 18 returns to perform the suspicion-level calculating task of the next cycle from the operation in step S710 again.

That is, the center terminal 10 is programmed to perform the abnormal-situation probability calculating task that:

checks the already-collected pieces of monitored-area circumstance information against each other;

determines whether there is a strange object, such as a strange person and a strange vehicle, within the surrounding area AA based on the checked results;

determines the abnormal-situation probability using the already collected pieces of monitored-area circumstance information if it is determined that there is a strange object within the surrounding area AA; and sends the high-level suspicion information to the corresponding at least one currently monitoring security terminal 30 if it is determined that the determined abnormal-situation probability is equal to or higher than the threshold level.

As a result, as described above, the controller 38 of the at least one currently monitoring security terminal 30 sets the alert-level for the corresponding target object and the monitored area WA at the high level (see step S240 in FIG. 6).

Next, overall operations of the components of the security system 1 will be schematically described hereinafter with reference to FIG. 12.

Figure 12:
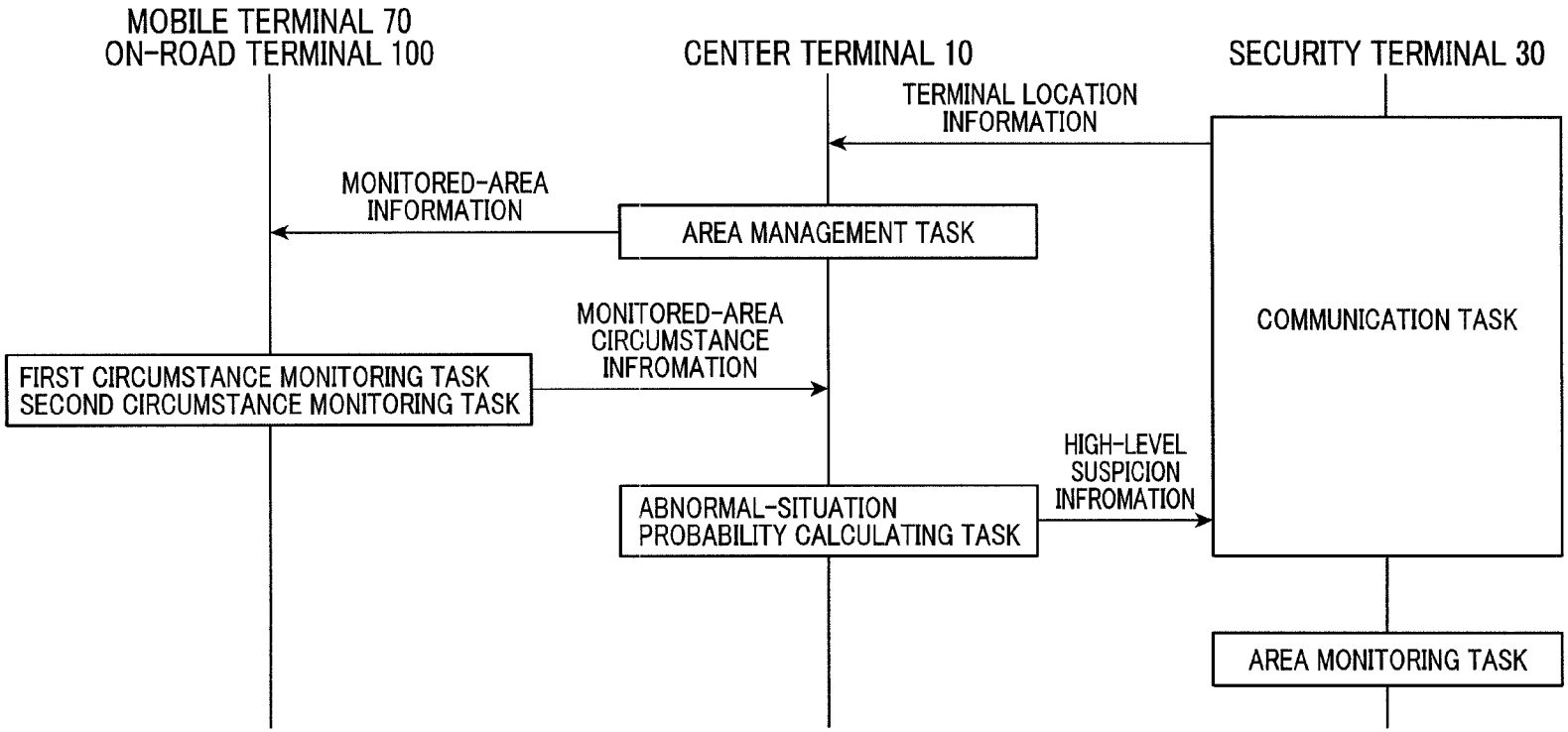
FIG. 12 is a sequence diagram schematically illustrating an example of overall operations of the security system according to the embodiment.

In the security system 1, referring to FIG. 12, a currently monitoring security terminal 30 for a target object performs the communication task to send the terminal location information to the center terminal 10 (see step S210 of FIG. 6). When receiving the terminal location information, the center terminal 10 performs the area management task that:

determines the monitored-area information about the monitored area WA corresponding to the currently monitoring security terminal 30;

firstly stores therein the currently determined monitored-area information, or updates the previous monitored-area information to the currently determined monitored-area information (see steps S610, 620, S625); and sends the firstly stored or updated monitored-area information to each of the mobile terminals 70 and the on-road terminals 100 (see steps S630 and S640).

When a mobile terminal 70 is currently receiving the monitored-area information, and determines that the motor vehicle of a mobile terminal 70 has entered the surrounding area AA defined by the monitored-area information for the at least one currently monitoring security terminal 30 (see YES in step S420), the mobile terminal 70 performs the first circumstance monitoring task to collect the monitored-area circumstance information around the corresponding motor vehicle within the surrounding area AA, and to send the monitored-area circumstance information to the center terminal 10 (see steps 430 and S440). Similarly, an on-road terminal 100, which is located within the surrounding area AA, receives the monitored-area information, and performs the second circumstance monitoring task to collect the monitored-area circumstance information around the corresponding on-road terminal 100 located within the surrounding area AA, and to send the monitored-area circumstance information to the center terminal 10 (see steps 520 and S530).

When receiving the monitored-area circumstance information from at least one mobile terminal 70 or at least one on-road terminal 100 (YES in step S710), the center terminal 10 performs the abnormal-situation probability calculating task, thus determining whether there is a strange object within the surrounding area AA (see step S730). Then, the center terminal 10 determines the abnormal-situation probability using the already collected pieces of monitored-area circumstance information if it is determined that there is a strange object within the surrounding area AA (see steps S730 and S740). Then, the center terminal 10 sends the high-level suspicion information to the corresponding at least one currently monitoring security terminal 30 if it is determined that the determined abnormal-situation probability is equal to or higher than the threshold level (see step S750).

When currently receiving the high-level suspicion information from the center terminal 10, the at least one currently monitoring security terminal 30 sets the alert level for the corresponding target object and the monitored area WA to be high (see step S240 in FIG. 6). Then, the at least one currently monitoring security terminal 30 performs the area monitoring task to:

increase a value of the cycle at which each of the sensors 42, 44, 46, and 48 to collect corresponding object situation information to be higher than the preset normal value for the case of the alert-level being low; and collect the corresponding object-situation information as the target-object information each time the object-information is collected by each of the sensors 42, 44, 46, and 48 at the determined value of the corresponding cycle (see steps S310 to S330).

As a result, if it is determined that there is an abnormal situation associated with the corresponding target object or the monitored area WA based on the collected target-object information (see YES in step S340), the at least one currently monitoring security terminal 30 drives the warning unit 50 so that the warning unit 50 outputs a warning (see step S350).

As described above, when currently receiving the high-level suspicion information, which shows that the probability of the occurrence of an abnormal situation associated with the corresponding target object or the monitored area WA is high, sent from the center terminal 10, each security terminal 30 increases the number of pieces of the corresponding object-situation information collected by the detecting unit 40 before the occurrence of an abnormal situation. In other words, the security system 1 is capable of performing one or more measures against the occurrence of an abnormal situation before the occurrence of an abnormal situation. This results in an increase in the reliability of the security system 1.

In addition, each security terminal 30 of the security system 1 is configured to determine whether there is an abnormal situation associated with the corresponding target object or the monitored area WA based on the increased number of pieces of collected object-situation information when currently receiving the high-level suspicion information. This permits each security terminal 30 to determine whether there is an abnormal situation associated with the corresponding target object or the monitored area WA based on a larger number of pieces of object-situation information, thus improving the accuracy of determining whether there is an abnormal situation associated with the corresponding target object or the monitored area WA.

Each security terminal 30 of the security system 1 determines, more safely, whether there is an abnormal situation associated with the corresponding target object or the monitored area WA if it is determined that the probability of the occurrence of an abnormal situation associated with the corresponding target object or the monitored area WA is high.

This reduces the occurrence of abnormal situations associated with the corresponding target object or the monitored area WA.

When each security terminal 30 of the security system 1 is not currently receiving the high-level suspicion information from the center terminal 10, it maintains the number of pieces of the corresponding object-situation information collected by the detecting unit 40 to be equal to a value collected by the detecting unit 40 before the occurrence of an abnormal situation. In other words, each security terminal 30 reduces the number of pieces of the corresponding object-situation information collected by the detecting unit 40 to be lower than that collected by the detecting unit 40 when the high-level suspicion information is being currently received thereby. This reduces power required to drive the various sensors 42 to 48 of the detecting unit 40 as compared to that for the cases where each security terminal 30 is currently receiving the high-level suspicion information.

The center terminal 10 of the security system 1 is configured to check the current monitored-area circumstance information against the previous pieces of monitored-area circumstance information, and determine that there is a strange event, such as the occurrence of a strange object, within the surrounding area AA based on the checked results. This configuration maintains, at a lower level, the processing load of the controller 18 for determining whether there is a strange event, in other words, a suspicious event, within the surrounding area AA.

Note that the various programs stored in the respective storage devices can be recorded in computer-readable storage media, such as DVD-ROMs, DVD-RAMs, CD-RAMs, CD-ROMs, hard-discs, and the like, and they can be loaded or downloaded into computers so as to be run. Each of the programs loaded or downloaded in the computer-readable storage media instructs a computer to run a corresponding task, thus serving the computers as the security system 1.

The present disclosure is not limited to the aforementioned embodiment, and therefore can be carried out as various modifications of the aforementioned embodiment.

For example, the security system 1 according to the aforementioned embodiment is equipped with a first group of the mobile terminals 70 and a second group of the on-road terminals 100, but a security system according to a modification of the aforementioned embodiment can be equipped with one of the first group of mobile terminals 70 and the second group of on-road terminals 100.

In the security system according to the aforementioned embodiment, the center terminal 10 checks the already-collected pieces of monitored-area circumstance information against each other, and determines that there is a strange event within the surrounding area AA based on the checked results. However, the present disclosure is not limited to the configuration.

Specifically, in the security system according to a modification of the aforementioned embodiment, the center terminal 10 can perform various methods to determine whether there is a strange event within the surrounding area AA based on the already-collected pieces of monitored-area circumstance information.

In the security system 1 according to the aforementioned embodiment, when each security terminal 30 is currently receiving the high-level suspicion information from the center terminal 10, it increases the amount of the corresponding object-situation information by increasing the sampling frequency at which the controller 38 acquires, from the detecting unit 40, the corresponding object-situation information. However, the present disclosure is not limited to the configuration. Specifically, when each security terminal 30 is currently receiving the high-level suspicion information from the center terminal 10, it can increase the number of activation of sensors in the detecting unit 40 for every collection cycle while keeping the number of pieces of the corresponding object-situation information collected by each of the increased number of sensors.

In the security system 1 according to the aforementioned embodiment, when each security terminal 30 is not currently receiving the high-level suspicion information from the center terminal 10, it reduces the amount of the corresponding object-situation information by reducing the sampling frequency at which the controller 38 acquires, from the detecting unit 40, the corresponding object-situation information. However, the present disclosure is not limited to the configuration. Specifically, when each security terminal 30 is not currently receiving the high-level suspicion information from the center terminal 10, it can reduce the number of activation of sensors in the detecting unit 40 for every collection cycle while keeping the number of pieces of the corresponding object-situation information collected by each of the reduced number of sensors.

As described above, when currently receiving the high-level suspicion information sent from the center terminal 10, each security terminal 30 of the security system 1 according to this embodiment increases the amount of the corresponding object-situation information collected by the detecting unit 40 before the occurrence of an abnormal situation. However, the present disclosure is not limited to the configuration. Specifically, each security terminal 30 of the security system 1 according to a modification of this embodiment can be configured to perform one or more measures against the occurrence of an abnormal situation before the occurrence of an abnormal situation. As the one or more measures, each security terminal 30 can instruct the warning unit 50 to output a warning, or can send warning information to a mobile terminal that the owner of the corresponding target object has.

Devices in each security terminal 30 for collecting the target object information are not limited to the sensors 42, 44, 46, and 48 constituting the detecting unit 40 or the units 62 and 64 constituting the information collecting unit 60. For example, at least one of the sensors 42, 44, 46, and 48 or at least one of the units 62 and 64 can serve as a device in each security terminal 30 for collecting the target object information. Moreover, in addition to the sensors 42, 44, 46, and 48 and the units 62 and 64, the mobile terminal 70 installed in at least one mobile object parked in the monitored area WA can serve as devices in each security terminal 30.

In this embodiment, the monitoring camera 44 and the pickup unit 62 in each security terminal 30 are designed as separated individual devices, but a single pickup device can serve as the monitoring camera 44 and the pickup unit 62 in each security terminal 30.

While an illustrative embodiment of the present disclosure has been described herein, the present disclosure is not limited to the embodiment described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. A security system comprising;

a first information collecting module configured to cyclically collect, as target-object information, information indicative of environments of a target object and a monitored area in which the target object exists;

an alarm module configured to:

determine whether there is an abnormal situation associated with at least one of the target object and the monitored area based on the target-object information collected by the first information collecting module, and set off an alarm upon determination that there is an abnormal situation associated with at least one of the target object and the monitored area;

a second information collecting module confirmed to cyclically collect, as circumstance information, information indicative of a situation of an area surrounding the monitored area; and an abnormal situation determining module configured to:

calculate, based on the circumstance information collected by the second formation collecting module, a probability that an abnormal situation associated with at least one of the target object and the monitored area will occur; and determine whether the probability that an abnormal situation associated with at least one of the target object and the monitored area will occur is equal to or higher than a threshold level, wherein the second information collecting module is installed in a mobile object, and comprises:

a first circumstance information obtaining module configured to cyclically obtain, as mobile-object circumstance information, information indicative of at least part of circumstances around the mobile object; and a second circumstance information obtaining module configured to cyclically obtain, as behavior information, information indicative of a behavior of the mobile object, the second information collecting module being configured to:

determine whether the mobile object is located within the surrounding area; and cyclically collect, as the circumstance information, at least one of: a piece of the mobile-object circumstance information obtained by the first circumstance information obtaining module; and a piece of the behavior information obtained by the second circumstance information collecting module until it is determined that the mobile object is located within the surrounding area.

2. The security system according to claim 1, further comprising:

a controlling module configured to control the first information collecting module to increase an amount of the target-object information collected by the first information collecting module if it is determined that the probability that an abnormal situation associated with at least one of the target object and the monitored area will occur is equal to or higher than the threshold level.

3. The security system according to claim 1, wherein the abnormal situation determining module comprises:

a storage module configured to store therein the circumstance information cyclically collected by the second information collecting module; and a calculating module configured to, each time a piece of the circumstance information is currently collected by the second information collecting module in a current cycle as current circumstance information, check the current circumstance information against pieces of the circumstance information that have been collected by the second information collecting module in the previous cycles and have been stored in the storage module, and calculate the probability that an abnormal situation associated with at least one of the target object and the monitored area will occur using the checked results.

4. The security system according to claim 1, wherein the abnormal situation determining module comprises:

a calculating module configured to check pieces of the circumstance information that have been collected in current and previous cycles against each other, and calculate the probability that an abnormal situation associated with at least one of the target object and the monitored area will occur using the checked results.

5. The security system according to claim 1, wherein the first information collecting module comprises:

a first sensor configured to cyclically obtain image information indicative of an image of at least part of the monitored area; and a second sensor configured to cyclically obtain break-in information indicative of whether there is a break-in object into the monitored area, the first information collecting module being configured to cyclically collect at least one of: a piece of the image information obtained by the first sensor; and a piece of the break-in information obtained by the second sensor.

6. A security system comprising;

a first information collecting module configured to cyclically collect, as target-object information, information indicative of environments of a target object and a monitored area in which the target object exists;

an alarm module configured to:

determine whether there is an abnormal situation associated with at least one of the target object and the monitored area based on the target-object information collected by the first information collecting module, and set off an alarm upon determination that there is an abnormal situation associated with at least one of the target object and the monitored area;

a second information collecting module configured to cyclically collect, as circumstance information, information indicative of a situation of an area surrounding the monitored area; and an abnormal situation determining module configured to:

calculate, based on the circumstance information collected by the second information collecting module a probability that an abnormal situation associated with at least one of the target object and the monitored area will occur; and determine whether the probability abnormal situation associated with at least one of the target object and the monitored area will occur is equal to or higher than a threshold level, wherein the second information collecting module is located on a road, and comprises:

a circumstance information obtaining unit configured to cyclically obtain, as road circumstance information, information indicative of at least part of circumstances around a location of the second information collecting module, the second information collecting module being configured to:

determine whether the location of the second information collecting module is within the surrounding area; and cyclically collect, as the circumstance information, a piece of the road circumstance information obtained by the circumstance information obtaining unit if it is determine that the location of the second information collecting module is within the surrounding area.

7. The security system according to claim 2, wherein, if it is determined that the probability that an abnormal situation associated with at least one of the target object and the monitored area will occur is lower than the threshold level, the controlling module is configured to control the first information collecting module to keep unchanged the amount of the target-object information collected by the first information collecting module.

8. A computer program product comprising:

a non-transitory computer-readable medium; and a set of computer program instructions embedded in the computer-readable medium, the instructions causing a computer of a security system to:

receive target-object information cyclically collected by another computer and sent therefrom, the target-object information being indicative of environments of a target object and a monitored area in which the target object exists;

receive circumstance information cyclically collected by another computer and sent therefrom, the circumstance information being indicative of a situation of an area surrounding the monitored area;

calculate, based on the circumstance information collected by the second information collecting module, a probability that an abnormal situation associated with at least one of the target object and the monitored area will occur; and determine whether the probability that an abnormal situation associated with at least one of the target object and the monitored area will occur is equal to or higher than a threshold level, wherein the another computer is installed in a mobile object, and the circumstance information cyclically collected by the another computer and received by the computer comprises at least one of:

a piece of mobile-object circumstance information; and a piece of behavior information, the mobile-object circumstance information being indicative of at least part of circumstances around a mobile object in which the another computer is installed, the behavior information being indicative of a behavior of the mobile object, the at least one of a piece of the mobile-object circumstance information and a piece of the behavior information being cyclically collected by the another computer and received by the computer until it is determined that the mobile object is located within the surrounding area.

9. A method of monitoring a target object in a security system, the method comprising:

cyclically collecting, as target-object information, information indicative of environments of the target object and a monitored area in which the target object sexists;

determining whether there is an abnormal situation associated with at least one of the target object and the monitored area based on the collected target-object information;

setting off an alarm indicative of a result of the determination that there is an abnormal situation associated with at least one of the target object and the monitored area;

cyclically collecting, as circumstance information, information indicative of a situation of an area surrounding the monitored area;

calculating, based on the collected circumstance information, a probability that an abnormal situation associated with at least one of the target object and the monitored area will occur; and determining whether the probability that an abnormal situation associated with at least one of the target object and the monitored area will occur is equal to or higher than a threshold level, wherein the cyclically collecting step comprises:

cyclically obtaining, as mobile-object circumstance information, information indicative of at least part of circumstances around a mobile object;

cyclically obtaining, as behavior information, indicative of a behavior of the mobile object;

determining whether the mobile object is located within the surrounding area; and cyclically collecting, as the circumstance information, at least one of: a piece of the mobile-object circumstance information; and a piece of the behavior information until it is determined that the mobile object is located within the surrounding area.

* * * * *